US009915894B2

(12) United States Patent
Bayubay et al.

(10) Patent No.: US 9,915,894 B2
(45) **Date of Patent: *Mar. 13, 2018**

(54) ELECTROPHOTOGRAPHIC IMAGE FORMING DEVICE HAVING A TONER CARTRIDGE THAT INCLUDES A MOVABLE PROJECTION FOR PROVIDING INSTALLATION FEEDBACK

(71) Applicant: LEXMARK INTERNATIONAL, INC., Lexington, KY (US)

(72) Inventors: Michael Nuestro Bayubay, Cebu (PH); Salvador Capurihan Bonanciar, Cebu (PH); Brian Scott Carpenter, Lexington, KY (US); Donato Austria Marmol, Legazpi (PH); Robert Watson McAlpine, Lexington, KY (US); Katrina Rosit Lactuan, Consolacion (PH)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/621,036

(22) Filed: Jun. 13, 2017

(65) Prior Publication Data

US 2017/0277075 A1 Sep. 28, 2017

Related U.S. Application Data

(63) Continuation of application No. 15/273,779, filed on Sep. 23, 2016, now Pat. No. 9,709,925, which is a (Continued)

(51) Int. Cl.

| | |
|---|---|
| ***G03G 15/08*** | (2006.01) |
| ***G03G 21/16*** | (2006.01) |
| ***G03G 21/18*** | (2006.01) |

(52) U.S. Cl.
CPC ..... *G03G 15/0886* (2013.01); *G03G 15/0863* (2013.01); *G03G 15/0865* (2013.01); (Continued)

(58) Field of Classification Search
CPC ..... G03G 15/0865; G03G 15/0886; G03G 15/0889; G03G 21/1676; G03G 2215/066; (Continued)

(56) References Cited

U.S. PATENT DOCUMENTS 9,360,797 B1 * 6/2016 Bayubay ..... G03G 15/0865

FOREIGN PATENT DOCUMENTS

EP 1950625 A2 7/2008

OTHER PUBLICATIONS

Examination Report dated Sep. 19, 2017 for European Patent Application No. 16174906.4.

* cited by examiner

*Primary Examiner* — Sophia S Chen

(57) ABSTRACT

An electrographic image forming device according to one example embodiment includes toner cartridge having a housing that includes a toner reservoir. An outlet port faces downward on a front of the housing near a first side of the housing. A linkage is positioned on the first side of the housing and has an engagement surface that is accessible at the rear of the housing. A projection is positioned on the first side of the housing and is movable between a first position and a second position. The projection is operatively connected to the linkage such that the projection moves upward from the first position to the second position when the engagement surface receives a forward force that is toward (Continued)

the front of the housing. The projection extends outward sideways from the first side when the projection is in the second position.

24 Claims, 19 Drawing Sheets

Related U.S. Application Data continuation of application No. 15/143,713, filed on May 2, 2016, now Pat. No. 9,477,176, which is a continuation of application No. 14/825,400, filed on Aug. 13, 2015, now Pat. No. 9,360,797.

(52) U.S. Cl.
CPC ..... *G03G 15/0889* (2013.01); *G03G 21/1896* (2013.01); *G03G 21/1676* (2013.01); *G03G 2215/067* (2013.01)

(58) Field of Classification Search
CPC ..... G03G 2221/163; G03G 15/0863; G03G 21/1896; G03G 2215/067
See application file for complete search history.

ELECTROPHOTOGRAPHIC IMAGE FORMING DEVICE HAVING A TONER CARTRIDGE THAT INCLUDES A MOVABLE PROJECTION FOR PROVIDING INSTALLATION FEEDBACK

CROSS REFERENCES TO RELATED APPLICATIONS

This patent application is a continuation application of U.S. patent application Ser. No. 15/273,779, filed Sep. 23, 2016, entitled "Toner Cartridge Having a Movable Projection for Providing Installation Feedback to an Image Forming Device," which is a continuation application of U.S. patent application Ser. No. 15/143,713, filed May 2, 2016, now U.S. Pat. No. 9,477,176, issued Oct. 25, 2016, entitled "Toner Cartridge Having a Movable Projection for Providing Installation Feedback to an Image Forming Device," which is a continuation application of U.S. patent application Ser. No. 14/825,400, filed Aug. 13, 2015, now U.S. Pat. No. 9,360,797, issued Jun. 7, 2016, entitled "Toner Cartridge Having a Movable Projection for Providing Installation Feedback to an Image Forming Device."

BACKGROUND

1. Field of the Disclosure

The present disclosure relates generally to image forming devices and more particularly to a toner cartridge having a movable projection for providing installation feedback to an image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more toner cartridges that must be replaced periodically to continue to provide toner to the image forming device for printing. It is desired to communicate various conditions of the toner cartridge to the image forming device for proper operation.

SUMMARY

A toner cartridge according to one example embodiment includes a housing having a top, a bottom, a front, and a rear positioned between a first side and a second side of the housing. The housing has a reservoir for holding toner. An outlet port is in fluid communication with the reservoir and faces downward on the front of the housing near the first side of the housing for exiting toner from the toner cartridge. A linkage is positioned on the first side of the housing. The linkage has an engagement surface that is accessible at the rear of the housing. A projection is positioned on the first side of the housing. The projection is movable between a first position and a second position. The projection extends outward sideways from the first side when the projection is in the second position. The projection is operatively connected to the linkage such that the projection moves upward from the first position to the second position when the engagement surface receives a forward force that is toward the front of the housing. The projection is unobstructed to contact and push upward on an arm in the image forming device when the projection moves upward from the first position to the second position in order to change a state of a sensor in the image forming device when the toner cartridge is installed in the image forming device. In some embodiments, the projection is biased toward the first position. Embodiments include those wherein the linkage is biased rearward toward the rear of the housing.

In some embodiments, an alignment guide extends outward sideways on the first side of the housing. In the second position, a top portion of the projection is positioned higher than at least a portion of a top surface of the alignment guide. In the first position, the projection may extend outward sideways from the first side and may be in line with the alignment guide from the rear to the front of the housing. The alignment guide may run from the rear to the front on the first side of the housing.

Embodiments include those wherein the projection moves outward sideways from the first side as the projection moves from the first position to the second position.

Some embodiments include a shutter movable between a closed position blocking the outlet port and an open position unblocking the outlet port. The shutter is operatively connected to the linkage such that the shutter moves from the closed position to the open position when the engagement surface receives the forward force that is toward the front of the housing.

In some embodiments, a channel runs along the front of the housing between the first side and the second side in fluid communication with the outlet port. At least a portion of the channel is open to the reservoir. An auger is positioned in the channel and extends along the front of the housing between the first side and the second side. The auger is operative to move toner in the channel toward the outlet port. In the second position, a top portion of the projection is positioned higher than a bottom surface of the channel. In the second position, a top portion of the projection is positioned in line with the channel from the second side to the first side of the housing. A toner delivery assembly is positioned in the reservoir to deliver toner to the channel. The toner delivery assembly includes a drive shaft rotatably mounted in the reservoir. The drive shaft includes a rotational axis. In the second position, a top portion of the projection is positioned higher than the rotational axis of the drive shaft.

A toner cartridge according to another example embodiment includes a housing having a top, a bottom, a front, and a rear positioned between a first side and a second side of the housing. The housing has a reservoir for holding toner. An outlet port is in fluid communication with the reservoir and faces downward on the front of the housing near the first side of the housing for exiting toner from the toner cartridge. A linkage is positioned on the first side of the housing. The linkage has an engagement surface that is accessible at the rear of the housing to receive an actuation force at the rear of the housing. The linkage is movable forward toward the front of the housing upon the engagement surface receiving the actuation force at the rear of the housing. A flag is positioned on the first side of the housing. The flag is movable between a first position and a second position. The flag extends outward sideways from the first side when the flag is in the second position. The flag is operatively connected to the linkage such that forward movement of the linkage causes the flag to move upward from the first position to the second position permitting the flag to change a state of a sensor in the image forming device when the toner cartridge is installed in the image forming device.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
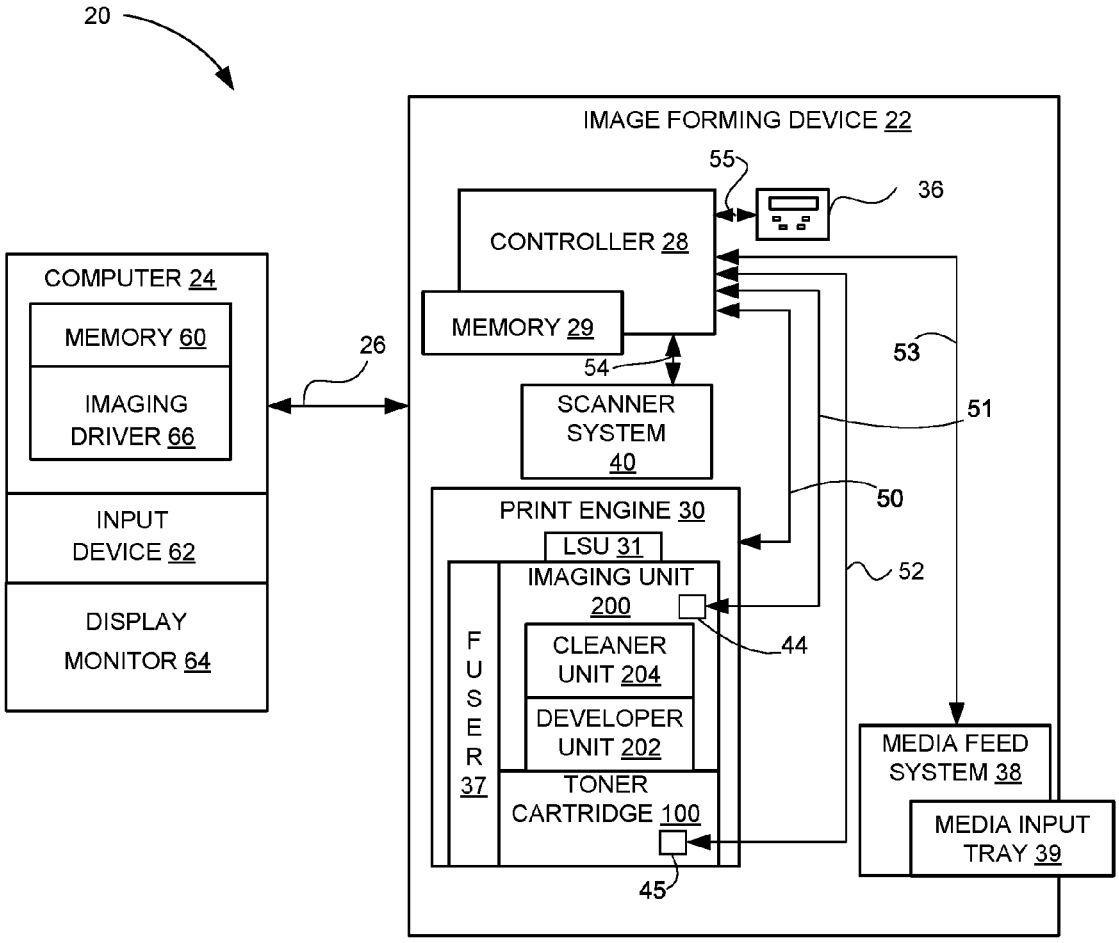
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 to communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more Application-specific integrated circuits (ASICs). Memory 29 may be any volatile or non-volatile memory or combination thereof such as, for example, random access memory (RAM), read only memory (ROM), flash memory and/or non-volatile RAM (NVRAM). Alternatively, memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 200 and toner cartridge 100, respectively. Controller 28 processes print and scan data and operates print engine 30 during printing and scanner system 40 during scanning.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200, and a fuser 37, all mounted within image forming device 22. Imaging unit 200 is removably mounted in image forming device 22 and includes a developer unit 202 that houses a toner sump and a toner development system. In one embodiment, the toner development system utilizes what is commonly referred to as a single component development system. In this embodiment, the toner development system includes a toner adder roll that provides toner from the toner sump to a developer roll. A doctor blade provides a metered uniform layer of toner on the surface of the developer roll. In another embodiment, the toner development system utilizes what is commonly referred to as a dual component development system. In this embodiment, toner in the toner sump of developer unit 202 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 202 includes a magnetic roll that attracts the magnetic carrier beads having toner thereon to the magnetic roll through the use of magnetic fields. Imaging unit 200 also includes a cleaner unit 204 that houses a photoconductive drum and a waste toner removal system.

Toner cartridge 100 is removably mounted in imaging forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner sump in developer unit 207.

The electrophotographic printing process is well known in the art and, therefore, is described briefly herein. During a printing operation, laser scan unit 31 creates a latent image on the photoconductive drum in cleaner unit 204. Toner is transferred from the toner sump in developer unit 202 to the latent image on the photoconductive drum by the developer roll (in the case of a single component development system) or by the magnetic roll (in the case of a dual component development system) to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
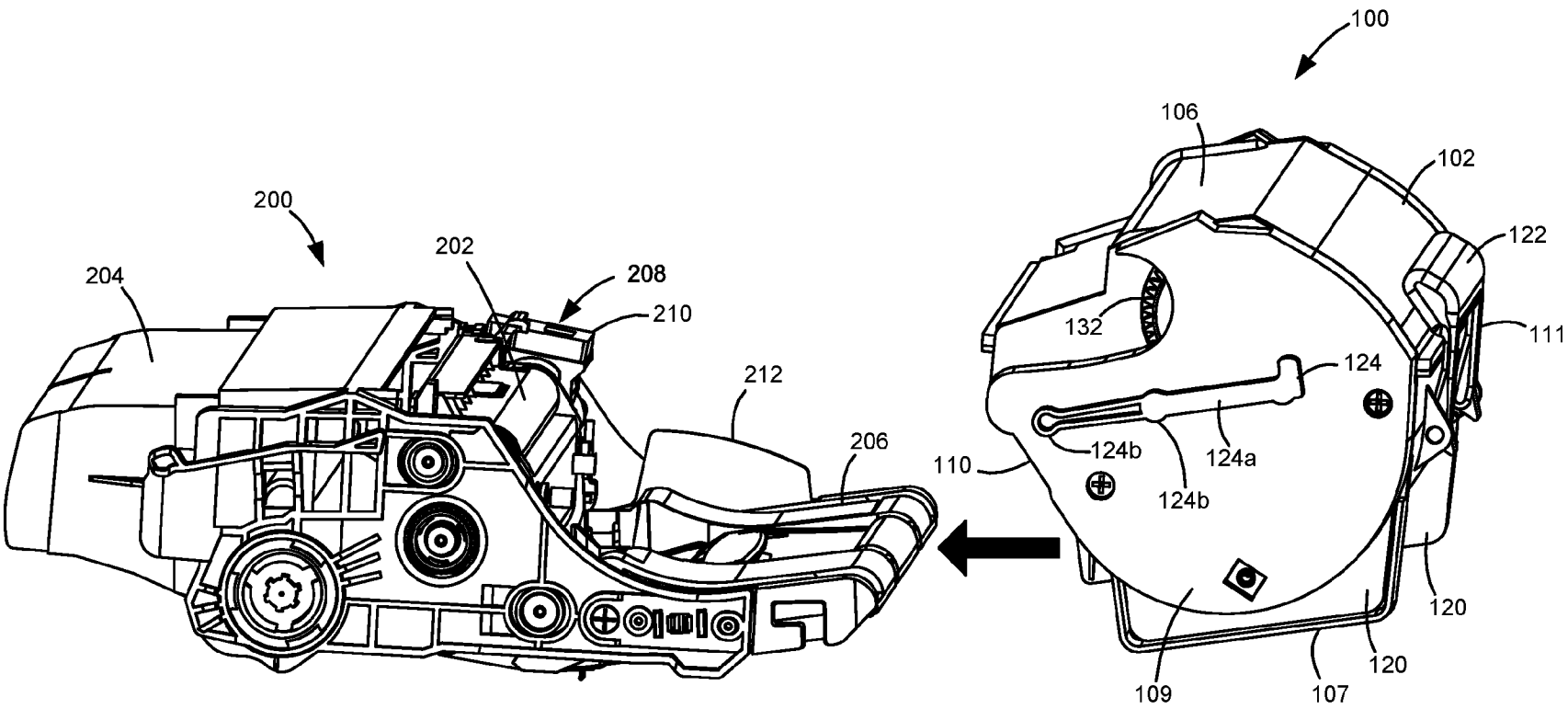
FIG. 2 is a perspective view of a toner cartridge and an imaging unit according to one example embodiment.

Referring now to FIG. 2, toner cartridge 100 and imaging unit 200 are shown according to one example embodiment. Imaging unit 200 includes a developer unit 202 and a cleaner unit 204 mounted on a common frame 206. Developer unit 202 includes a toner inlet port 208 positioned to receive toner from toner cartridge 100. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto frame 206 in a mating relationship with developer unit 202 of imaging unit 200 as indicated by the arrow shown in FIG. 2. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, cleaner unit 204 or frame 206 or to clear a media jam.

With reference to FIGS. 2-5, toner cartridge 100 includes a housing 102 having an enclosed reservoir 104 (FIG. 5) for storing toner. Housing 102 includes a top 106, a bottom 107, first and second sides 108, 109, a front 110 and a rear 111. Front 110 of housing 102 leads during insertion of toner cartridge 100 into image forming device 22 and rear 111 trails. In one embodiment, each side 108, 109 of housing 102 includes an end cap 112, 113 mounted, e.g., by fasteners or a snap-fit engagement, to side walls 114, 115 of a main body 116 of housing 102. An outlet port 118 in fluid communication with reservoir 104 is positioned on front 110 of housing 102 near side 108 for exiting toner from toner cartridge 100. Housing 102 may include legs 120 on bottom 107 to assist with the insertion of toner cartridge 100 into image forming device 22 and to support housing 102 when toner cartridge 100 is set on a flat surface. A handle 122 may be provided on top 106 or rear 111 of housing 102 to assist with insertion and removal of toner cartridge 100 into and out of image forming device 22.

Figure 3:
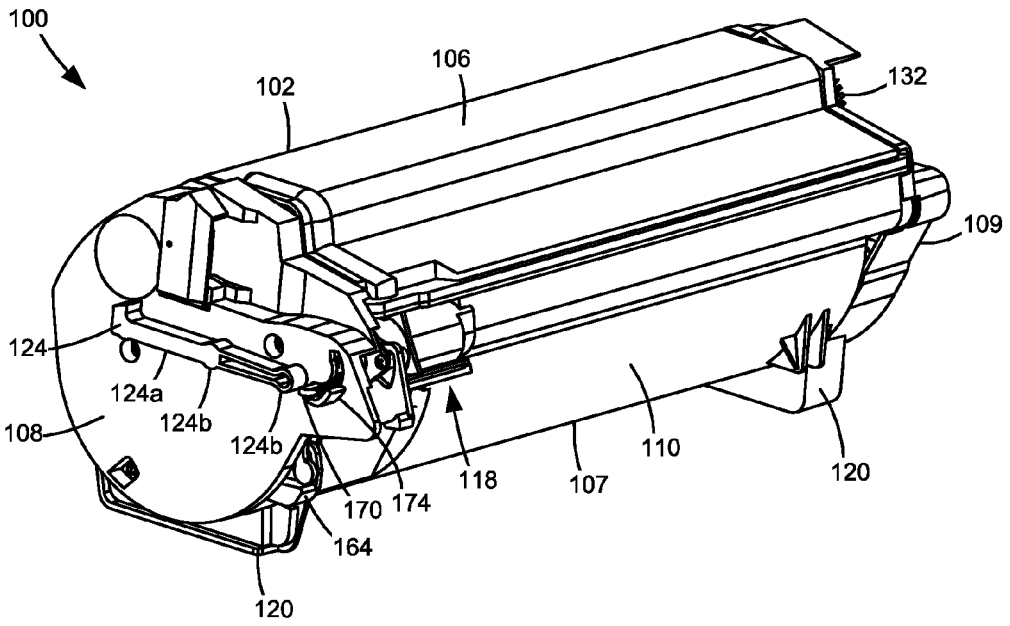
FIG. 3 is a front perspective view of the toner cartridge shown in FIG. 2.
Figure 4:
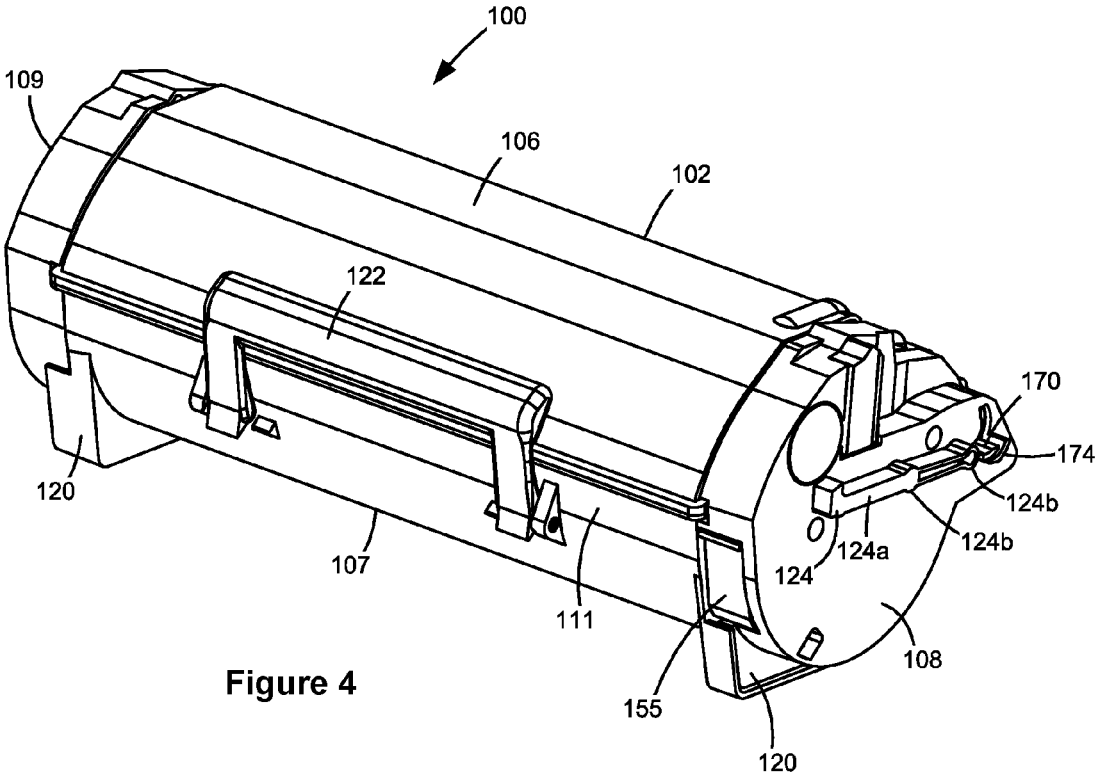
FIG. 4 is a rear perspective view of the toner cartridge shown in FIGS. 2 and 3.

Sides 108, 109 may each include an alignment guide 124 that extends outward from the respective side 108, 109 to assist, the insertion of toner cartridge 100 into image forming device 22. Alignment guides 124 travel in corresponding guide slots in image forming device 22 that guide the insertion of toner cartridge 100 into image forming device 22. In the example embodiment illustrated, an alignment guide 124 is positioned on the outer side of each end cap 112, 113. Alignment guides 124 may run along a front-to-rear dimension of housing 102 as shown in FIGS. 2-4. In the example embodiment illustrated, each alignment guide 124 includes a wing member 124*a* that runs from front to rear on a respective side 108, 109 of housing 102. In the example embodiment illustrated, each alignment guide 124 also includes one or more rounded projections 124*b* formed on the bottom of wing member 124*a*. Rounded projections 124*b* define contact surfaces on the bottom of alignment guide 124 that ride on top of a corresponding guide surface as toner cartridge 100 is inserted into image forming device 22. However, alignment guide 124 may take many other suitable shapes and forms. For example, in another embodiment, alignment guide 124 includes one or more ribs on each side 108, 109 of housing 102 that extend from front to rear. In another embodiment, alignment guide 124 includes one or more rounded pegs or projections from each side 108, 109, similar to rounded projections 124*b*, that may be spaced along the front-to-rear dimension of housing 102 from each other.

As discussed in greater detail below, toner cartridge 100 also includes a projection 170 on side 108 that is movable between a first position and a second position to signal to controller 28 that toner cartridge 100 is installed in image forming device 22.

Figure 5:
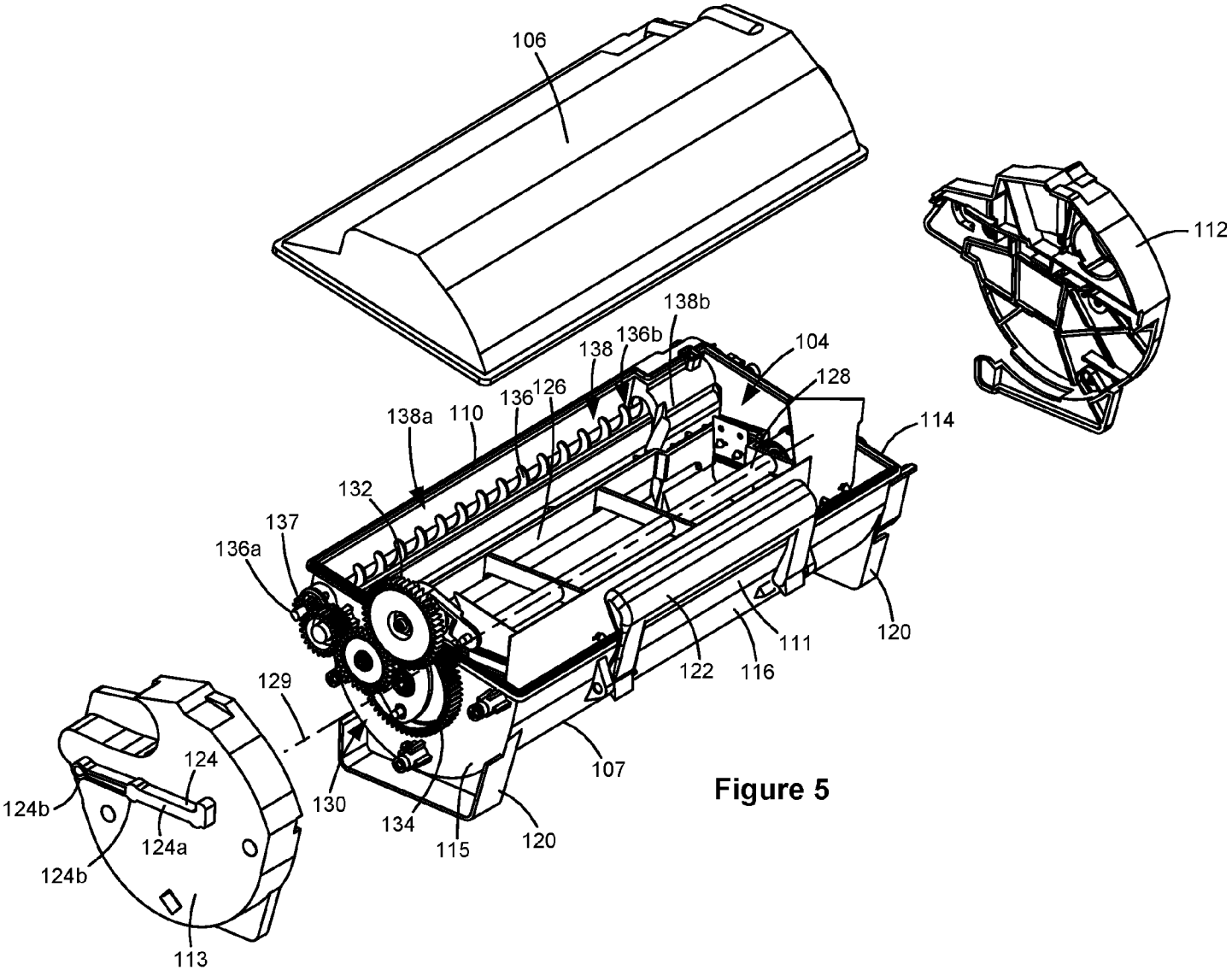
FIG. 5 is an exploded view of the toner cartridge shown in FIGS. 2-4 showing a reservoir for holding toner therein.

With reference to FIG. 5, a toner delivery assembly 126 is rotatably mounted within toner reservoir 104 with first and second ends of a drive shaft 128 of toner delivery assembly 126 extending through aligned openings in side walls 114, 115, respectively. Drive shaft 128 includes a rotational axis 129. Bushings may be provided on each end of drive shaft 128 where drive shaft 128 passes through side walls 114, 115. A drive train 130 is operatively connected to drive shaft 128 and may be positioned within a space formed between end cap 113 and side wall 115. Drive train 130 includes a main interface gear 132 that engages with a drive system in image forming device 22 that provides torque to main interface gear 132. As shown in FIG. 3, in one embodiment, a front portion of main interface gear 132 is exposed at the front 110 of housing 102 near the top 106 of housing 102 where main interface gear 132 engages the drive system in image forming device 22. With reference back to FIG. 5, drive train 130 also includes a drive gear 134 on one end of drive shaft 128 that is connected to main interface gear 132 either directly or via one or more intermediate gears to rotate drive shaft 128.

An auger 136 having first and second ends 136*a*, 136*b* and a spiral screw flight is positioned in a channel 138 that runs along the front 110 of housing 102 from side 108 to side 109. Channel 138 may be integrally molded as part of the front 110 of main body 116 or formed as a separate component that is attached to the front 110 of main body 116. Channel 138 is generally horizontal in orientation along with toner cartridge 100 when toner cartridge 100 is installed in image forming device 22. Outlet port 118 is positioned at the bottom of channel 138 so that gravity assists in exiting toner through outlet port 118. First end 136*a* of auger 136 extends through side wall 115 and a drive gear 137 of drive train 130 is provided on first end 136*a* that is connected to main interface gear 132 either directly or via one or more intermediate gears. Channel 138 includes an open portion 138*a* and may include an enclosed portion 138*b*. Open portion 138*a* is open to toner reservoir 104 and extends from side 109 toward second end 136*b* of auger 136. Enclosed portion 138*b* of channel 138 extends from side 108 and encloses second end 136*b* of auger 136. In this embodiment, outlet port 118 is positioned at the bottom of enclosed portion 138*b* of channel 138.

Figure 6:
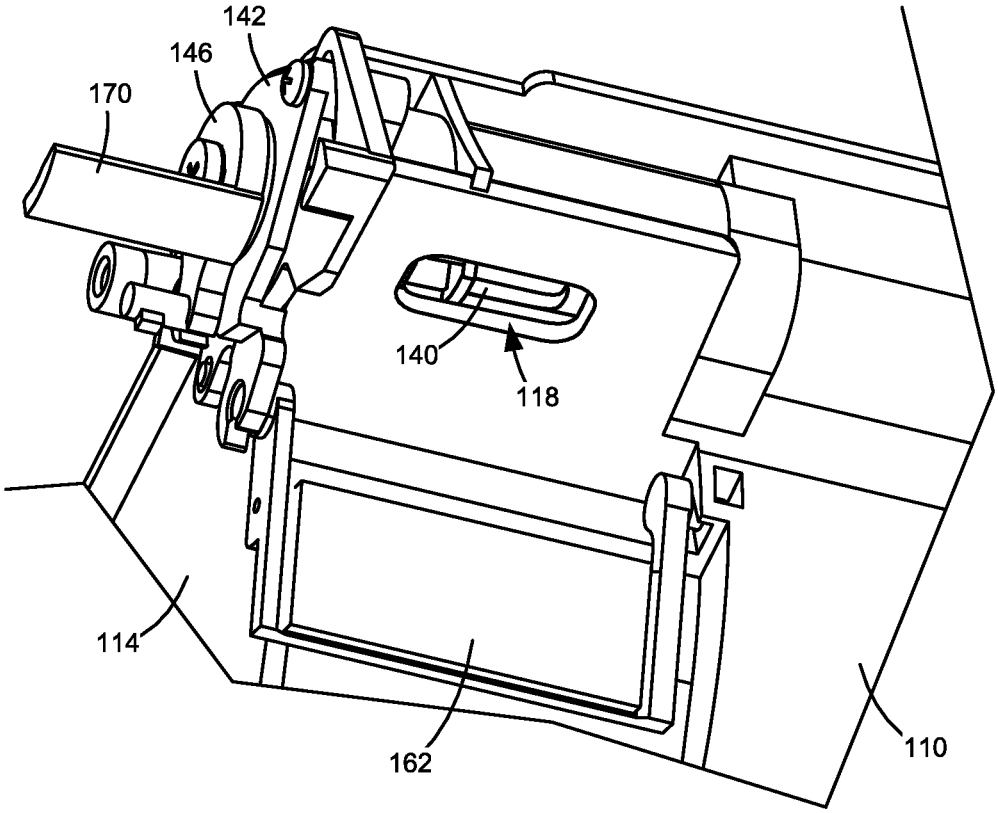
FIG. 6 is a perspective view of a front portion of the toner cartridge shown in FIGS. 2-5 showing an outlet port according to one example embodiment.

With reference to FIG. 6, in some embodiments, toner cartridge 100 includes a shutter 140 that regulates whether toner is permitted to exit toner cartridge 100 through outlet port 118. Shutter 140 is shown in more detail in FIGS. 7A, 7B, 8A and 8B. Shutter 140 is rotatable between a closed position shown in FIGS. 7A and 8A and an open position shown in FIGS. 6, 7B and 8B. Shutter 140 includes an open end 140*a* that receives second end 136*b* of auger 136 therein. As auger 136 rotates, it delivers toner from channel 138 to shutter 140. Shutter 140 includes a radial opening 140*b* that is connected to open end 140*a* by an internal channel in shutter 140. Radial opening 140*b* permits toner to exit toner cartridge 100 through outlet port 118 as discussed in greater detail below.

A retaining member 142 is mounted on side wall 114 of toner cartridge 100 (FIG. 6). In the example embodiment illustrated, retaining member 142 is a separate component attached to housing 102; however, retaining member 142 may also be integrally molded as part of housing 102.

Retaining member 142 includes a bushing 144 that receives a closed end 140*c* of shutter 140. Closed end 140*c* of shutter 140 is connected to a lever 146 that opens and closes shutter 140. In the example embodiment illustrated, closed end 140*c* of shutter 140 includes a key 148 and lever 146 includes a corresponding keyway 149. Key 148 and keyway 149 couple shutter 140 to lever 146 such that the rotation of lever 146 opens and closes shutter 140. It will be appreciated that this configuration may be reversed so that lever 146 includes a key and closed end 140*c* of shutter 140 includes a corresponding keyway. In the embodiment illustrated, lever 146 is connected to closed end 140*c* via a fastener 150 that passes through keyway 149 and a threaded hole 151 in closed end 140*c*; however, lever 146 and shutter 140 may be connected by any suitable means such as by being snap fit together. A post 152 is provided on the distal end of lever 146.

Figure 7A:
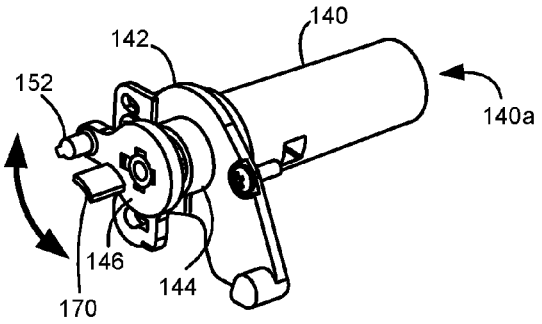
FIGS. 7A and 7B are perspective views of a shutter assembly of the toner cartridge in a closed position and an open position, respectively, according to one example embodiment.
Figure 7B:
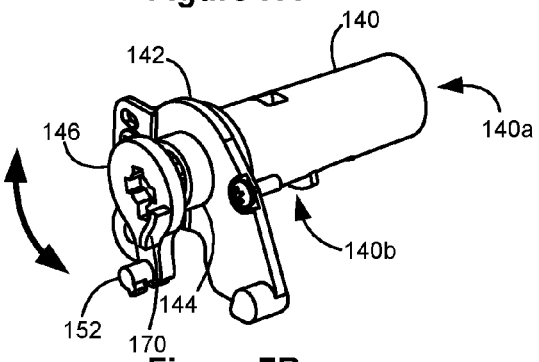
Figure 8A:
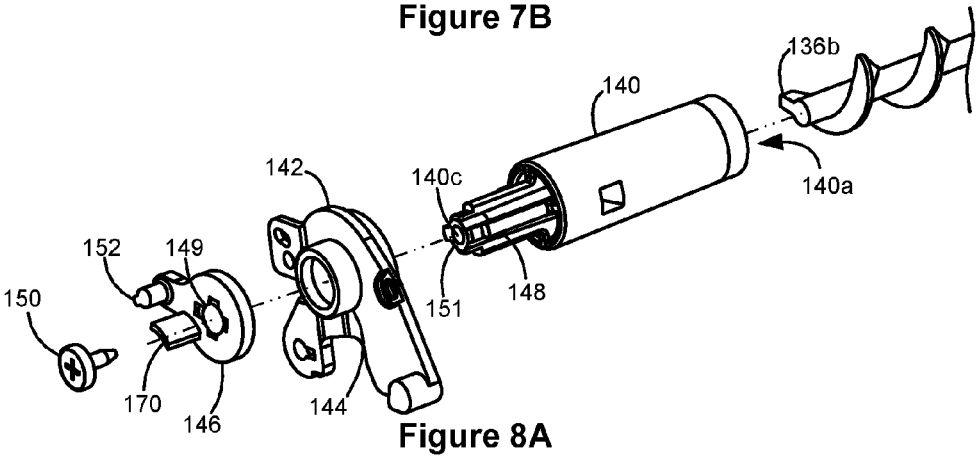
FIGS. 8A and 8B are exploded views of the shutter assembly shown in FIGS. 7A and 7B.
Figure 8B:
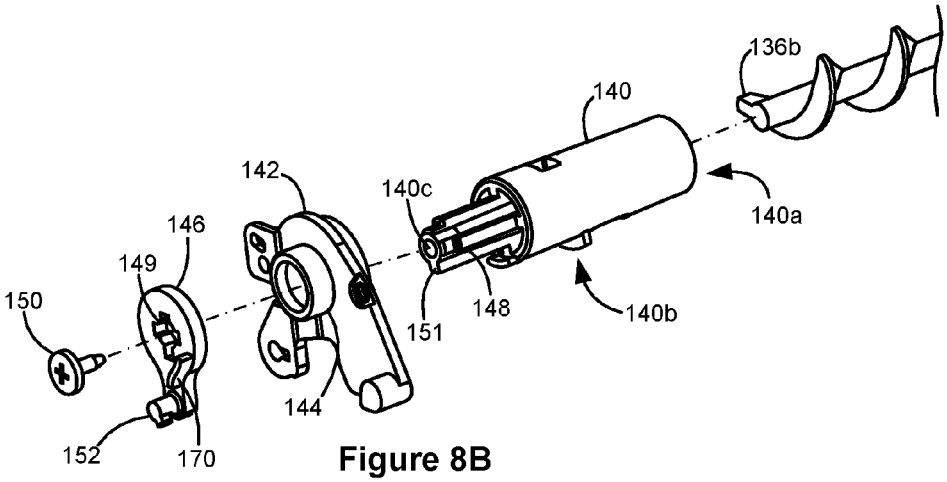

When lever 146 is in a first position shown in FIGS. 7A and 8A, shutter 140 is in a closed position with radial opening 140*b* positioned against an internal surface of enclosed portion 138*b* of channel 138 in order to prevent toner from exiting toner cartridge 100. When lever 146 rotates to a second position shown in FIGS. 7B and 8B, shutter 140 rotates to an open position where radial opening 140*b* is aligned with outlet port 118 to permit toner to exit toner cartridge 100. When shutter 140 is in the open position, toner may be delivered from reservoir 104 of toner cartridge 100 to imaging unit 200 by rotating toner delivery assembly 126 and auger 136 as desired. Specifically, as toner delivery assembly 126 rotates, one or more toner agitators, such as paddles, scrapers or the like, delivers toner from toner reservoir 104 into open portion 138*a* of channel 138. As auger 136 rotates, it delivers toner received in channel 138 to shutter 140 in enclosed portion 138*b* of channel 138 through open end 140*a*. Toner passes through the internal channel in shutter 140 and out of radial opening 140*b* and outlet port 118 into the corresponding inlet port 208 in developer unit 202 (FIG. 2). In one embodiment, inlet port 208 of developer unit 202 is surrounded by a foam seal 210 that traps residual toner and prevents toner leakage at the interface between outlet port 118 and inlet port 208.

Figure 9:
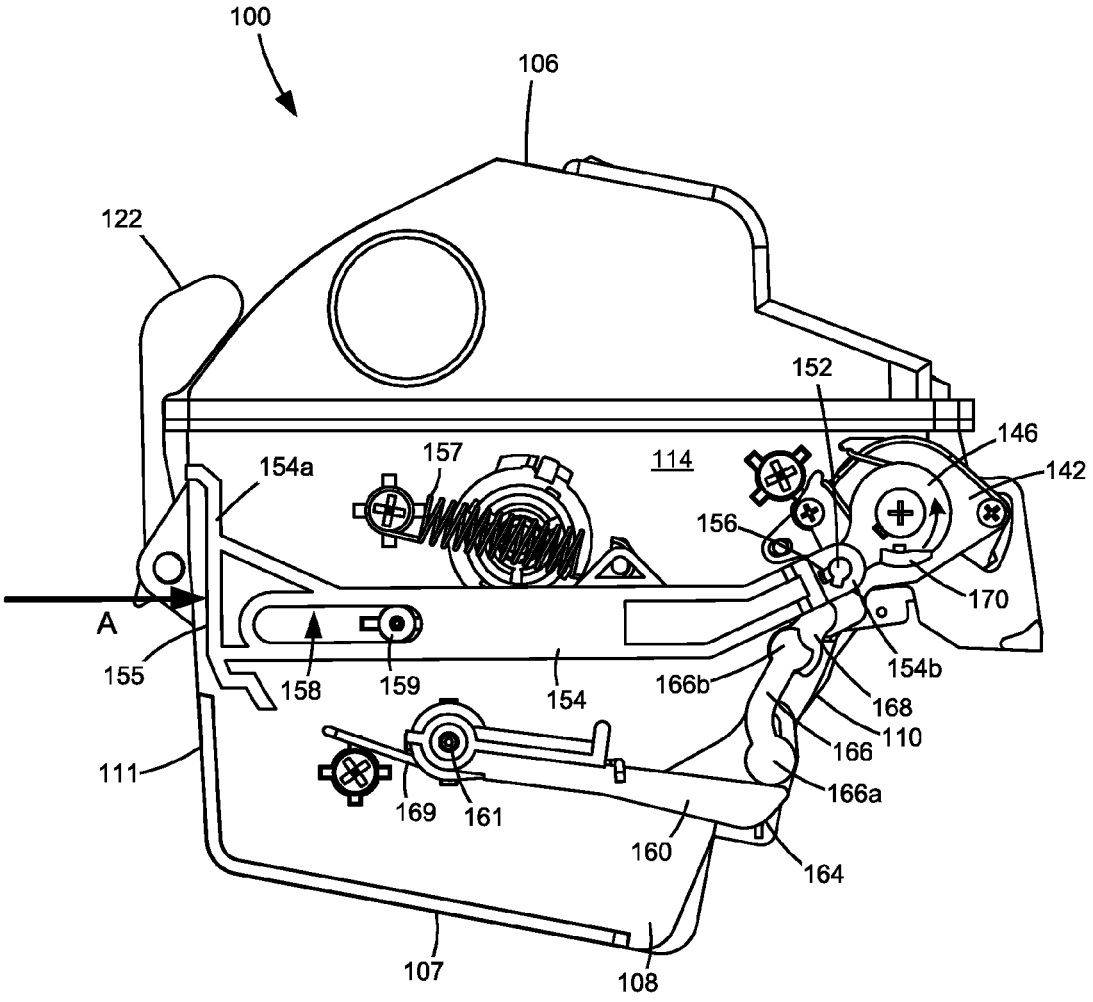
FIG. 9 is a side elevation view of the toner cartridge with an end cap omitted according to one example embodiment.

FIG. 9 shows side 108 of housing 102 according to one example embodiment with end cap 112 omitted. A linkage 154 is positioned on side 108 of housing 102 between end cap 112 and side wall 114 that actuates lever 146 to open and close shutter 140 when toner cartridge 100 is installed in image forming device 22. Linkage 154 is an elongated member that extends from a first end 154*a* to a second end 154*b* of linkage 154. Linkage 154 includes an engagement surface 155, such as a button-like area, at first end 154*a* that is exposed on the rear 111 of housing 102, such as at a rear portion of end cap 112 next to side wall 114 as shown in FIG. 4. In one embodiment, linkage 154 is operatively connected to shutter 140 at second end 154*b* to move shutter 140 from the closed position to the open position when linkage 154 is moved in a forward direction toward front 110 of housing 102 when engagement surface 155 is depressed. For example, in the embodiment illustrated, linkage 154 is connected at second end 154*b* to lever 146, which opens and closes shutter 140. In the example embodiment illustrated, second end 154*b* of linkage 154 includes a channel 156 that receives post 152 extending from lever 146. However, linkage 154 may be operatively connected to shutter 140 by any suitable means and may take other forms and shapes as desired.

Linkage 154 is biased by one or more biasing members, such as an extension spring 157, toward the rear 111 of housing 102 where engagement surface 155 is exposed, i.e., toward the position shown in FIG. 9, to close shutter 140 Linkage 154 is translatable in the forward direction shown by arrow A in FIG. 9 when engagement surface 155 is depressed and the biasing force is overcome. As linkage 154 moves forward, lever 146 rotates opening shutter 140. Linkage 154 includes an elongated slot 158 that receives a corresponding post 159 on end cap 112 or side wall 114. The engagement between slot 158 and post 159 guides the movement of linkage 154.

After toner cartridge 100 is inserted into image forming device 22, when an access door to image forming device 22 is closed, a plunger or other projection extending from an inner side of the access door (or otherwise linked to the access door) presses engagement surface 155 overcoming the biasing force on linkage 154 and moving linkage 154 forward toward front 110 causing lever 146 to rotate and open shutter 140. When the access door to image forming device 22 is opened to remove toner cartridge 100 from image forming device 22, this sequence is reversed such that the bias on linkage 154 causes linkage 154 to move rearward toward rear 111 causing lever 146 to rotate and close shutter 140.

In some embodiments, a raisable linkage 160 is positioned between end cap 112 and side wall 114 that opens and closes a cover 162 on outlet port 118 as described and illustrated in U.S. Pat. No. 8,649,710 titled "Toner Cartridge having a Pivoting Exit Port Cover." Cover 162 is pivotable between a closed position where a sealing face of cover 162 is pressed against an outer portion of outlet port 118 to trap any residual toner within outlet port 118 and an open position (shown in FIG. 6) where cover 162 is pivoted away from outlet port 118 and positioned against the front 110 of housing 102 below outlet port 118 with the sealing face of cover 162 facing forward away from the front 110 of housing 102. Linkage 160 is pivotable about an axis of rotation 161. Linkage 160 extends along side wall 114 from its axis of rotation 161 toward the front 110 of housing 102. Linkage 160 includes an engagement surface 164 that is exposed at the front 110 of housing 102, such as at a front portion of end cap 112 next to side wall 114 as shown in FIG. 3. In one embodiment, linkage 160 is operatively connected to cover 162 to move cover 162 from the closed position to the open position when engagement surface 164 contacts a corresponding engagement feature on imaging unit 200 as toner cartridge 100 is inserted into image forming device 22. For example, in the embodiment illustrated, a lifting linkage 166 is connected at one end 166*a* to linkage 160 and at another end 166*b* to a rotating linkage 168, which is connected to cover 162. However, linkage 160 may be operatively connected to cover 162 by any suitable means.

Linkage 160 is biased downward, i.e., in a clockwise direction as viewed in FIG. 9, by one or more biasing members, such as a torsion spring 169, to close cover 162. When toner cartridge 100 is inserted into image forming device 22, engagement surface 164 of linkage 160 contacts a fin or other engagement feature 212 on frame 206 of imaging unit 200 (FIG. 2). The contact between engagement feature 212 and engagement surface 164 causes linkage 160 to pivot upward in a counter-clockwise direction as viewed in FIG. 9. As linkage 160 pivots upward, linkage 166 raises upward causing linkage 168 to rotate clockwise as viewed in FIG. 9 which causes cover 162 to pivot from the closed position to the open position. When toner cartridge 100 is separated from imaging unit 200, this sequence is reversed such that the bias on linkage 160 causes linkage 160 to pivot downward in a clockwise direction as viewed in FIG. 9 causing linkage 166 to lower, linkage 168 to rotate counter-clockwise as viewed in FIG. 9 and cover 162 to pivot closed.

A projection 170 is positioned on side 108 of housing 102 and is operatively connected to linkage 154 such that projection 170 moves from a first position (FIGS. 9-11) to a second position (FIGS. 12 and 13) as a result of the forward movement of linkage 154. In the example embodiment illustrated, projection 170 extends outward sideways from lever 146, which is operatively connected to linkage 154 as discussed above. Projection 170 may be biased toward its first position. For example, the bias applied to linkage 154 by extension spring 157 may, in turn, bias projection 170 to its first position. In the embodiment illustrated, projection 170 has a rib-like shape in the form of a flag; however, projection 170 may take any suitable shape.

With reference to FIGS. 10-13, the movement of projection 170 from its first position to its second position changes the state of a sensor 300 (shown schematically in dashed lines) in image forming device 22 in communication with controller 28 signaling to controller 28 that toner cartridge 100 is installed in image forming device 22. As mentioned above, image forming device 22 includes a guide slot 306 (shown schematically in dashed lines) on each side 108, 109 of toner cartridge 100 that receives an alignment guide 124 and guides the motion of toner cartridge 100 as toner cartridge 100 is inserted into image forming device 22. Specifically, alignment guides 124 ride on top of a bottom guide 307 of each guide slot 306 such that contact between bottom guides 307 and bottom surfaces of alignment guides 124 defines the vertical position of toner cartridge 100 as toner cartridge 100 is inserted in image forming device 22. Guide slot 306 may also include a top guide 308 to limit upward movement of toner cartridge 100 as toner cartridge 100 is inserted into image forming device 22 to further guide toner cartridge 100 to its operating position in image forming device 22. Sensor 300 is positioned to detect the movement of projection 170 from its first position to its second position. In the example embodiment illustrated in FIGS. 10-13, sensor 300 is an optical sensor that includes an optical emitter 302 positioned to emit optical energy toward a receiver 303. Receiver 303 is configured to detect the presence or absence of the optical energy. Emitter 302 and receiver 303 are separated from each other by a gap 304 through which the optical path of sensor 300 passes. In this embodiment, sensor 300 is positioned above guide slot 306 and gap 304 is accessible from guide slot 306 through an opening 309 in top guide 308.

Figure 10:
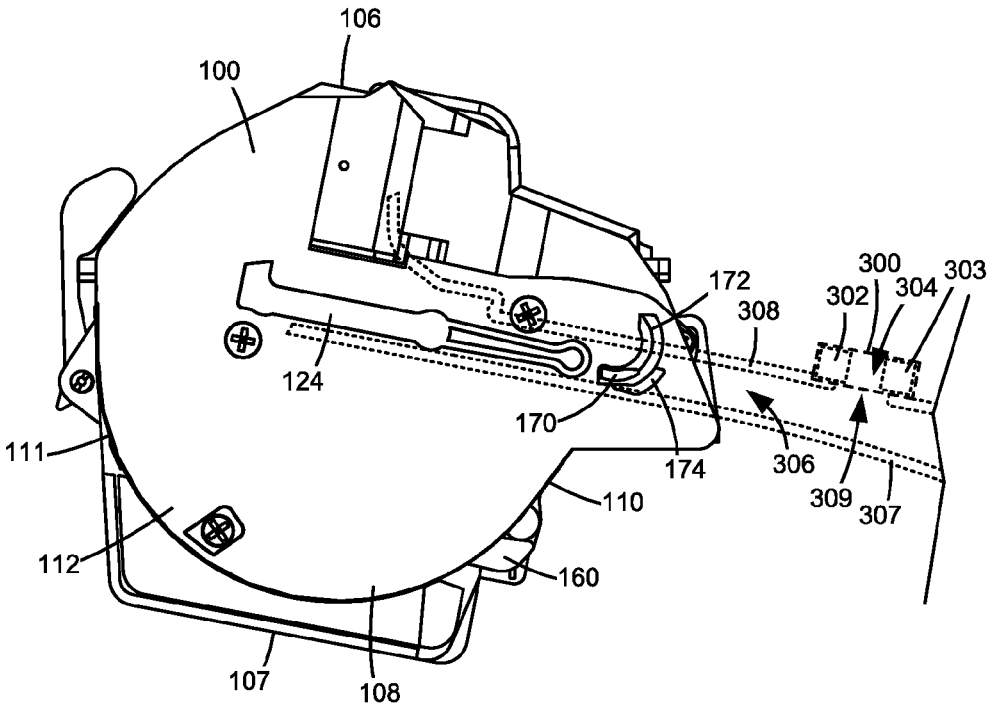
FIG. 10 is a side elevation view of the toner cartridge during insertion into the image forming device showing a projection on the side of the toner cartridge in a first position and a sensor positioned to detect the projection according to one example embodiment.

FIG. 10 shows toner cartridge 100 in an intermediate position during insertion into image forming device 22 with projection 170 in its first position as a result of the bias on linkage 154. In this embodiment, when projection 170 is in its first position, projection 170 extends outward sideways from side 108 and is in line with alignment guide 124 from rear to front relative to housing 102 as shown in FIG. 10 such that projection 170 travels in guide slot 306 during insertion of toner cartridge 100 into image forming device 22. In the example embodiment illustrated, projection 170 extends through a slot 172 in end cap 112 that is shaped to accommodate the motion of projection 170. In one embodiment, end cap 112 also includes a shield 174 positioned in front of projection 170 when projection 170 is in its first position. Shield 174 protects projection 170 from contact with image forming device 22 in the event that toner cartridge 100 is not properly aligned with guide slot 306 when toner cartridge 100 is inserted into image forming device 22.

Figure 11:
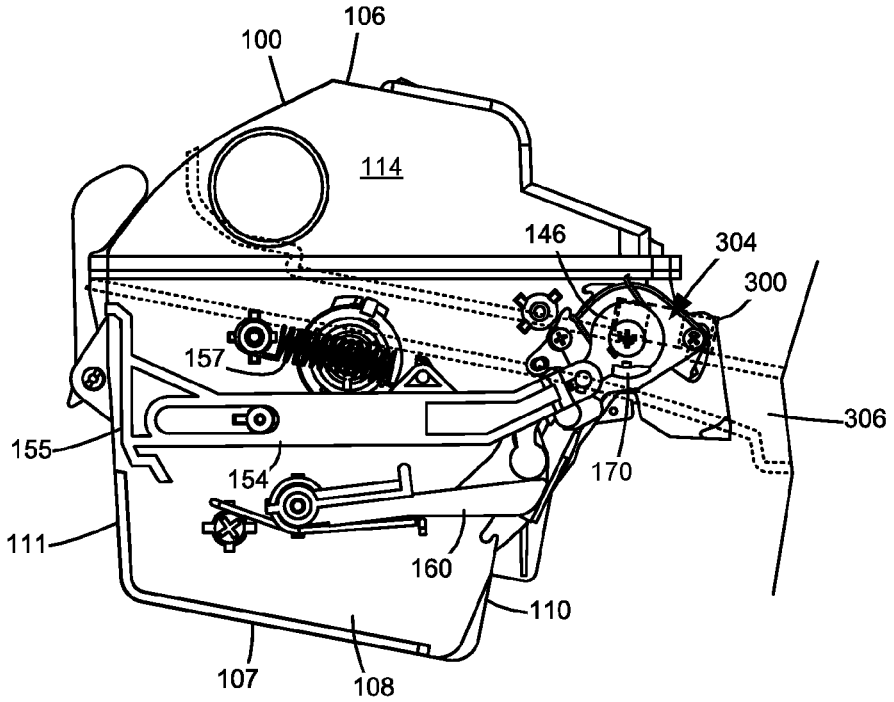
FIG. 11 is a side elevation view of the toner cartridge with the end cap omitted when the toner cartridge is fully installed in the image forming device showing the projection in the first position and the sensor positioned to detect the projection according to one example embodiment.

FIG. 11 shows toner cartridge 100 with end cap 112 omitted for clarity in the final operating position of toner cartridge 100 in image forming device 22 with the access door to image forming device 22 open such that linkage 154 is not depressed. As a result, projection 170 is in its first position, in guide slot 306, and the optical path of sensor 300 is not interrupted by projection 170.

Figure 12:
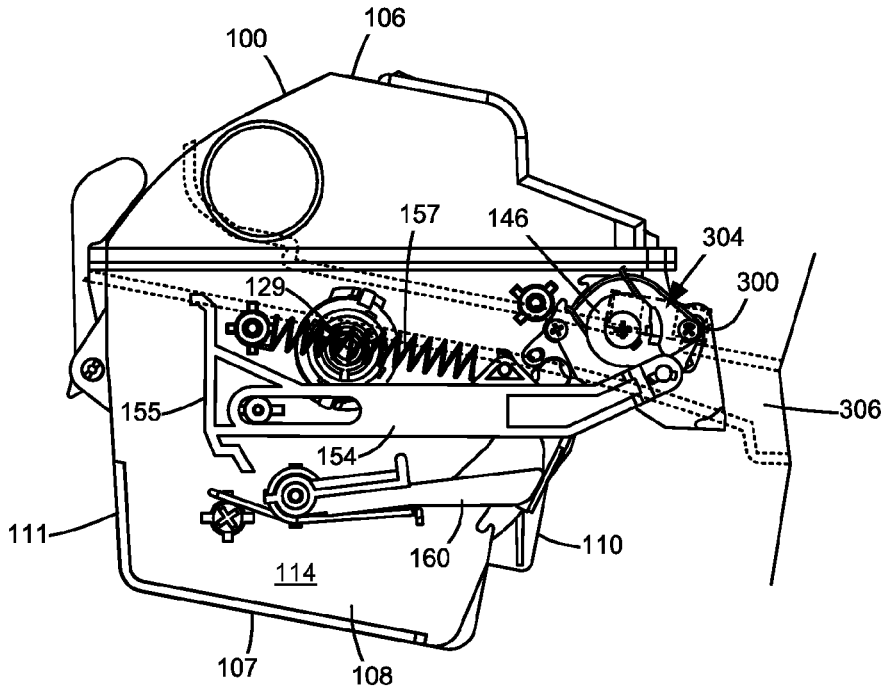
FIG. 12 is a side elevation view of the toner cartridge with the end cap omitted when the toner cartridge is fully installed in the image forming device showing the projection in a second position and the sensor positioned to detect the projection according to one example embodiment.
Figure 13:
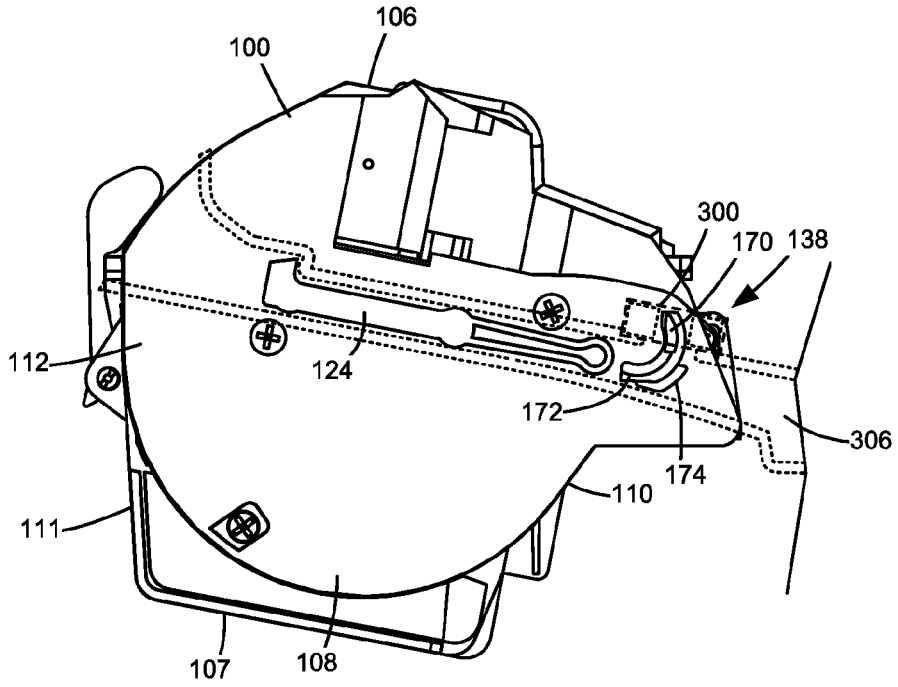
FIG. 13 is a side elevation view of the toner cartridge when the toner cartridge is fully installed in the image forming device showing the projection in the second position and the sensor positioned to detect the projection according to one example embodiment.

FIGS. 12 and 13 show toner cartridge 100 (with end cap 112 omitted in FIG. 12 and present in FIG. 13) in its final operating position in image forming device 22 with the access door to image forming device 22 closed and linkage 154 moved forward by the plunger on the inner side of the access door. The forward movement of linkage 154 causes projection 170 to move upward to its second position shown in FIGS. 12 and 13. In the embodiment illustrated, when projection 170 is in its second position, projection 170 blocks the optical path of sensor 300 thereby changing the state of sensor 300. Specifically, in the example embodiment illustrated, the forward movement of linkage 154 causes lever 146 to rotate counter-clockwise as viewed in FIGS. 12 and 13. Projection 170 travels upward along a partial circular path defined by the rotation of lever 146. In its second position, a top portion of projection 170 is positioned higher than the bottom of channel 138 and higher than rotational axis 129 of drive shaft 128. A top portion of projection 170 is also positioned higher than at least a portion of the top surface of alignment guide 124 when projection 170 is in its second position. In the example embodiment illustrated, in its second position, a top portion of projection 170 is in line with channel 138 from side to side relative to housing 102 as shown in FIG. 13; however, projection 170 and sensor 300 may be positioned further forward or rearward in other embodiments. In the example embodiment illustrated, the forward movement of linkage 154 also causes shutter 140 to open as discussed above. When the access door to image forming device 22 opens, this sequence is reversed returning projection 170 to its first position as shown in FIG. 11. Specifically, when the access door to image forming device 22 opens, linkage 154 moves rearward as a result of the bias applied to linkage 154. The rearward movement of linkage 154 causes lever 146 to rotate clockwise as viewed in FIGS. 12 and 13 which, in turn, causes projection 170 to move downward to its first position and shutter 140 to close. The downward movement of projection 170 from its second position to its first position allows gravity to assist in returning projection 170 to its first position.

The changing state of sensor 300 resulting from the movement of projection 170 from its first position to its second position signals to controller 28 of image forming device 22 that toner cartridge 100 is fully installed in image forming device 22 and the access door to image forming device 22 is closed. In contrast, when the optical path of sensor 300 is unblocked, controller 28 determines that toner cartridge 100 is not fully installed in image forming device 22 or the access door to the image forming device is open indicating that image forming device 22 is not ready to print. Further, where toner cartridge 100 includes a shutter 140 actuated by linkage 154, the changing state of sensor 300 resulting from the movement of projection 170 from its first position to its second position signals to controller 28 that shutter 140 is open and ready to deliver toner from reservoir 104. Accordingly, if linkage 154 or lever 146 experiences a mechanical failure causing shutter 140 to fail to open in response to the access door to image forming device 22 closing, controller 28 will recognize that shutter 140 is closed and unable to deliver toner from reservoir 104.

Projection 170 is positioned on the same side 108 of housing 102 as outlet port 118 instead of on side 109 to decrease the distance between outlet port 118 and projection 170 when projection 170 is in its second position in order to ensure that outlet port 118 is properly positioned to deliver toner to inlet port 208 when sensor 300 detects projection 170.

Figure 14:
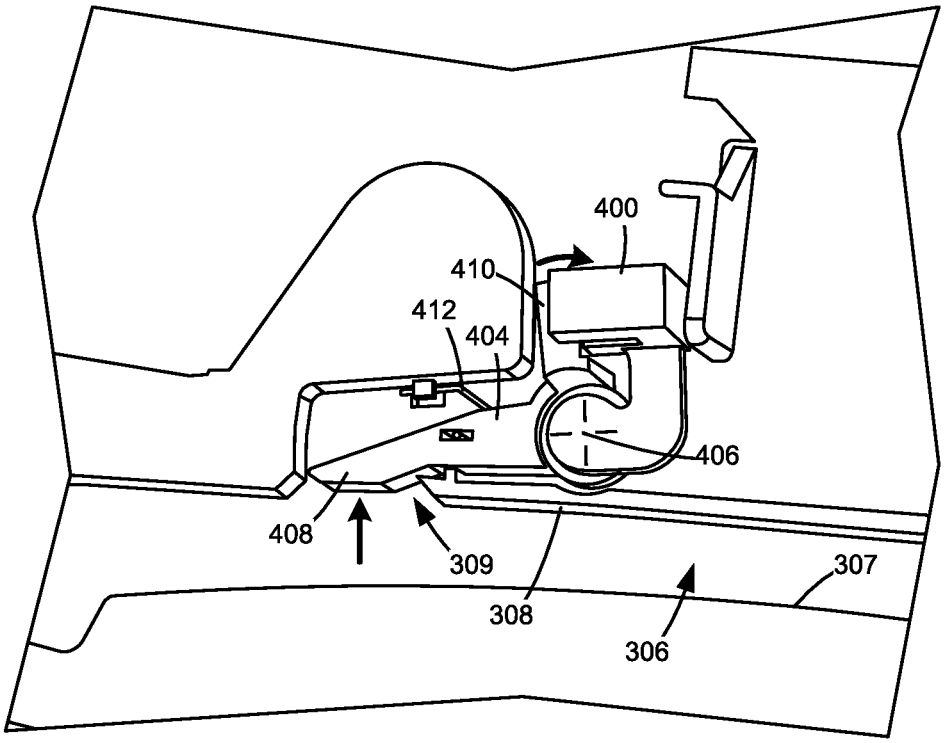
FIG. 14 is a perspective view of a sensor positioned to detect the projection of the toner cartridge according to another example embodiment.

The configurations of linkage 154, projection 170 and sensor 300 are not limited to the example embodiment shown in FIGS. 9-13. Other configurations are possible. For example, FIG. 14 shows a sensor 400 according to another example embodiment. In this embodiment, sensor 400 is obscured above top guide 308 of guide slot 306, i.e., sensor 400 is not directly accessible through opening 309 in top guide 308. An intermediate member such as a bell crank 404 is positioned to change the state of sensor 400 in response to the movement of projection 170 from its first position to its second position and vice versa. Bell crank 404 is pivotable about a pivot axis 406 between a first position of bell crank 404 (shown in FIG. 14) and a second position of bell crank 404 as indicated by the arrows in FIG. 14. Bell crank 404 includes an arm 408 that is accessible from below by projection 170 through opening 309 in top guide 308 and a flag 410 that blocks and unblocks the optical path of sensor 400 when bell crank 404 pivots. FIG. 14 shows bell crank 404 in its first position with arm 408 lowered and flag 410 spaced outside of the optical path of sensor 400. In the embodiment illustrated, bell crank 404 is biased toward its first position by a biasing member, such as a torsion spring 412. When toner cartridge 100 is in its final operating position in image forming device 22 and projection 170 moves upward from its first position to its second position, projection 170 pushes up on arm 408 overcoming the bias on arm 408 and causing bell crank 404 to pivot clockwise as viewed in FIG. 14 to the second position of bell crank 404 where flag 410 blocks the optical path of sensor 400. When the access door to image forming device 22 opens and projection 170 returns from its second position to its first position, the bias on bell crank 404 causes bell crank 404 to pivot counter-clockwise as viewed in FIG. 14 back to the first position of bell crank 404 where flag 410 does not block the optical path of sensor 400. Accordingly, bell crank 404 permits projection 170 to indirectly change the state of sensor 400 when projection 170 moves from its first position to its second position and vice versa. While the example embodiment illustrated in FIG. 14 shows flag 410 unblocking the optical path of sensor 400 when projection 170 is in its first position and blocking the optical path of sensor 400 when projection 170 is in its second position, this configuration may be reversed as desired.

Figure 15:
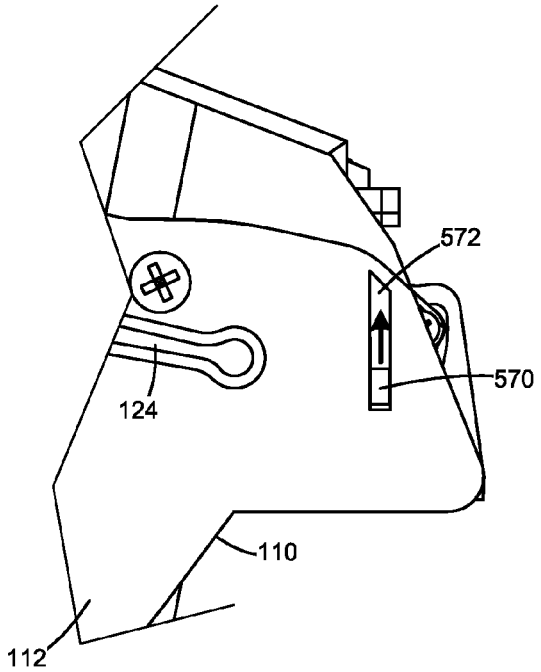
FIG. 15 is a side elevation view of the toner cartridge showing a projection on the side of the toner cartridge in a first position according to a second example embodiment.
Figure 16:
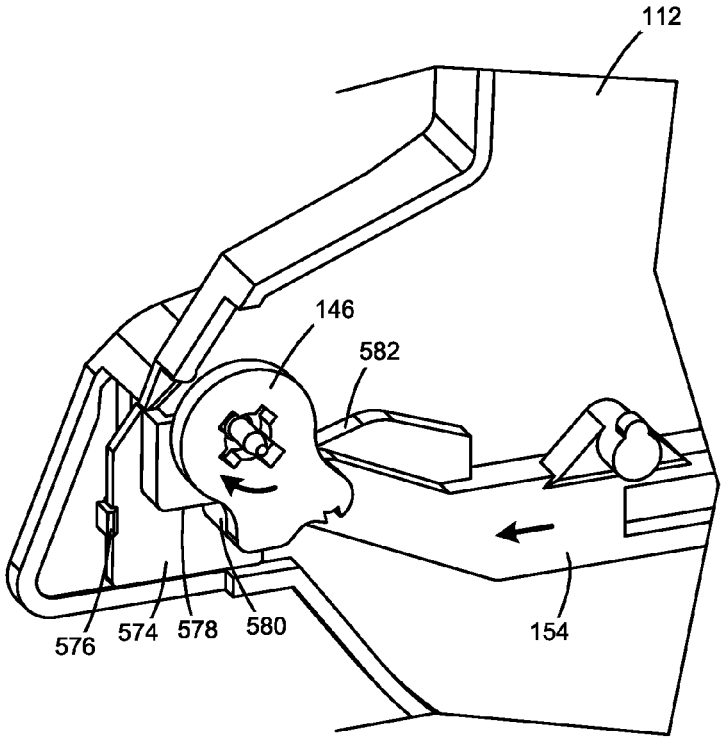
FIG. 16 is a front perspective view of an inner side of an end cap of the toner cartridge shown in FIG. 15 showing the projection in the first position.
Figure 17:
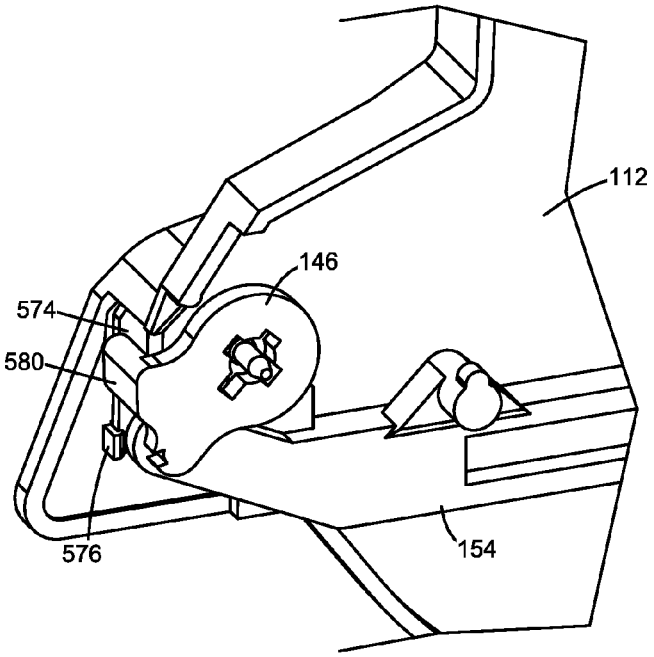
FIG. 17 is a front perspective view of the inner side of the end cap of the toner cartridge shown in FIGS. 15 and 16 showing the projection in a second position.

In another embodiment, the projection on toner cartridge 100 translates up and down between its first and second positions. For example, FIGS. 15-17 show toner cartridge 100 having a projection 570 according to one example embodiment that translates up and down between its first and second positions. As shown in FIG. 15, projection 570 projects outward sideways from side 108 of toner cartridge 100 through a vertical slot 572 in end cap 112. When projection 570 is in its first position as shown in FIG. 15, projection 570 is positioned in line with alignment guide 124 from rear to front relative to housing 102 as shown in FIG. 15 such that projection 570 travels in guide slot 306 during insertion of toner cartridge 100 into image forming device 22 as discussed above.

FIGS. 16 and 17 show an inner side of end cap 112 with projection 570 in its first and second positions, respectively, and main body 116 of toner cartridge 100 omitted for clarity. In this embodiment, projection 570 extends outward sideways from a raisable member 574 that is positioned between end cap 112 and side wall 114. In the example embodiment illustrated, raisable member 574 is retained against an inner side of end cap 112 by positioning tabs 576 that allow raisable member 574 to translate up and down but restrict raisable member 574 from moving in the front-to-rear and side-to-side dimensions of housing 102. Raisable member 574 includes a ledge 578 that forms a bottom contact surface of raisable member 574. Lever 146 includes a flange 580 that extends outwards sideways therefrom, toward the inner surface of end cap 112. Linkage 154 includes a cam surface 582 on a top portion thereof. When linkage 154 is in its biased position as shown in FIG. 16, ledge 578 of raisable member 574 rests on top of flange 580 with projection 570 in its first, lowered position. When engagement surface 155 is depressed, such as when the access door to image forming device 22 is closed, and linkage 154 moves forward, flange 580 rotates upward along a partial circular path with lever 146 and flange 580 exerts an upward force on ledge 578 causing raisable member 574 and projection 570 to translate upward from the first position of projection 570 toward the second position of projection 570. As linkage 154 continues to move forward and flange 580 continues to rotate, flange 580 travels forward past ledge 578 at which point cam surface 582 contacts ledge 578 from below. Cam surface 582 is angled to continue to exert an upward force on ledge 578 causing raisable member 574 to continue to translate upward until projection 570 reaches its second position as shown in FIG. 17. When the force on engagement surface 155 is removed, such as when the access door to image forming device 22 is opened, linkage 154 moves rearward as a result of the bias applied to linkage 154. The rearward movement of linkage 154 causes raisable member 574 to lower as cam surface 582 moves away from ledge 578 and flange 580 rotates downward in contact with ledge 578 causing projection 570 to return to its first position. Raisable member 574 may be biased downward toward the first position of projection 570 or raisable member 574 may rely on gravity to return projection 570 to its first position.

Figure 18:
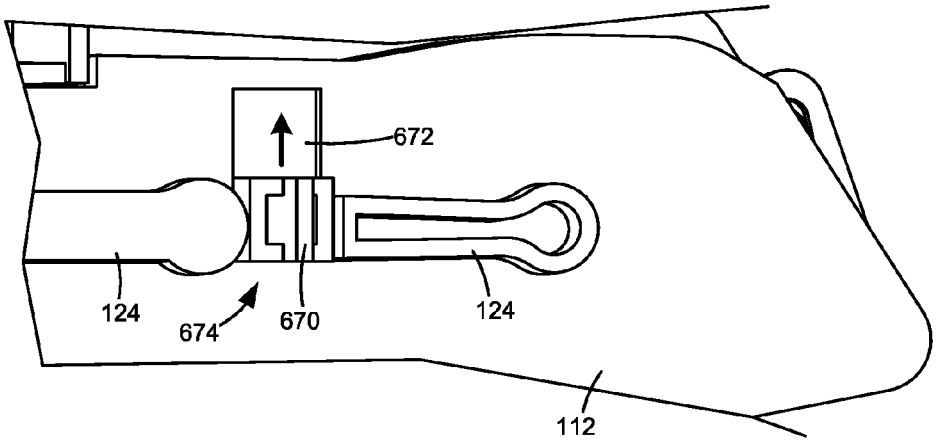
FIG. 18 is a side perspective view of the toner cartridge showing a projection on the side of the toner cartridge in a first position according to a third example embodiment.
Figure 19:
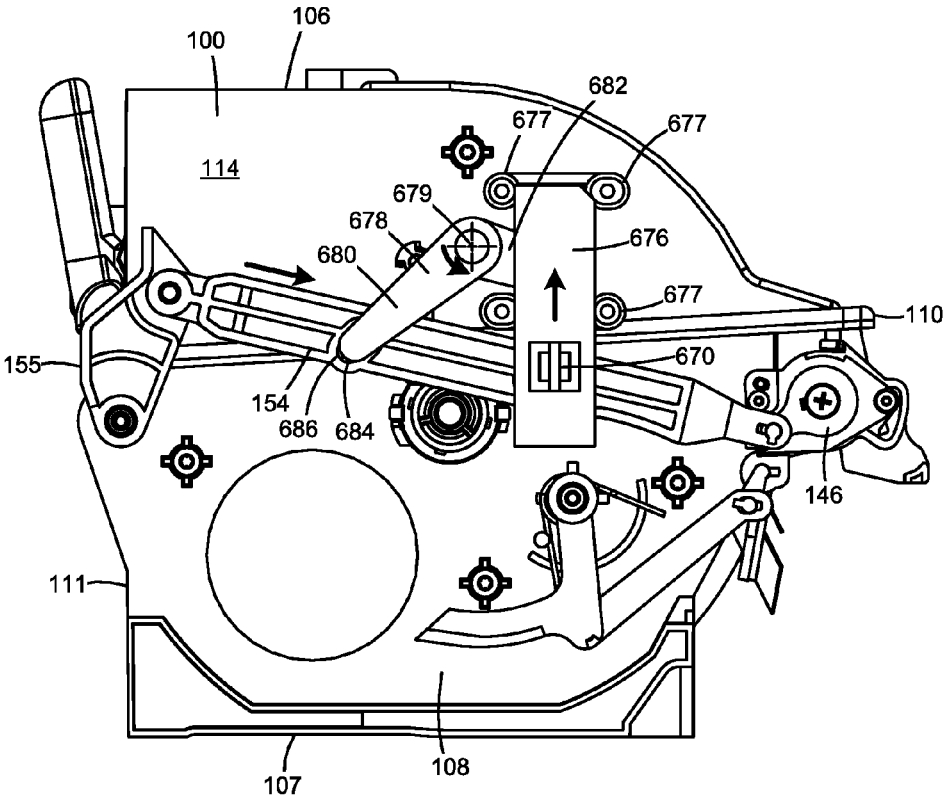
FIG. 19 is a side elevation view of the toner cartridge shown in FIG. 18 with the end cap omitted showing the projection in the first position.
Figure 20:
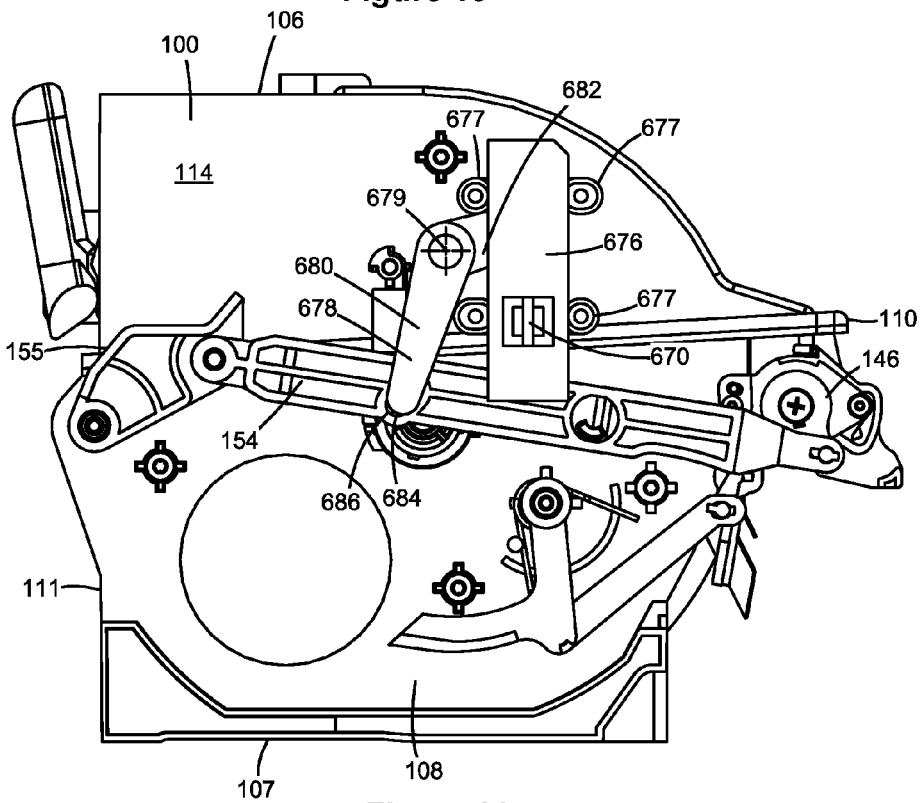
FIG. 20 is a side elevation view of the toner cartridge shown in FIGS. 18 and 19 with the end cap omitted showing the projection in a second position.

FIGS. 18-20 show toner cartridge 100 having a projection 670 according to another example embodiment that translates up and down between its first and second positions. As shown in FIG. 18, projection 670 projects outward sideways from side 108 of toner cartridge 100 through a vertical slot 672 in end cap 112. When projection 670 is in its first position as shown in FIG. 18, projection 670 is positioned in line with alignment guide 124 from rear to front relative to housing 102 as shown in FIG. 18 such that projection 670 travels in guide slot 306 during insertion of toner cartridge 100 into image forming device 22 as discussed above. In the example embodiment illustrated, projection 670 is positioned along the front-to-rear dimension of housing 102 in a break 674 in alignment guide 124.

FIGS. 19 and 20 show toner cartridge 100 with end cap 112 omitted for clarity and projection 670 in its first and second positions, respectively. In this embodiment, projection 670 extends outward sideways from a raisable member 676 that is positioned between end cap 112 and side wall 114. Raisable member 676 is retained against an inner side of end cap 112 by positioning tabs 677 that allow raisable member 676 to translate up and down but restrict raisable member 676 from moving in the front-to-rear dimension of housing 102. A bell crank 678 is positioned between end cap 112 and side wall 114. Bell crank 678 is pivotable about a pivot axis 679. Bell crank 678 includes a first arm 680 connected to linkage 154 and a second arm 682 connected to raisable member 676. When engagement surface 155 is depressed, such as when the access door to image forming device 22 is closed, the forward motion of linkage 154 causes bell crank 678 to rotate counter-clockwise as viewed in FIGS. 19 and 20 about pivot axis 679. The rotation of bell crank 678 causes arm 682 to lift raisable member 676 upward causing projection 670 to translate upward from its first position to its second position as shown in FIG. 20. In the example embodiment illustrated, arms 680, 682 each include a post 684 that is received by an elongated slot 686 in linkage 154 and raisable member 676 that allows arms 680, 682 to rotate about pivot axis 679 as linkage 154 and raisable member 676 translate. This configuration may be reversed as desired such that linkage 154 and raisable member 676 each include a post and arms 680, 682 each include an elongated slot. When the force on engagement surface 155 is removed, such as when the access door to image forming device 22 is opened, linkage 154 moves rearward as a result of the bias applied to linkage 154. The rearward movement of linkage 154 causes bell crank 678 to pivot clockwise as viewed in FIGS. 19 and 20 about pivot axis 679 which, in turn, causes raisable member 676 to lower causing projection 670 to return to its first position.

Figure 21:
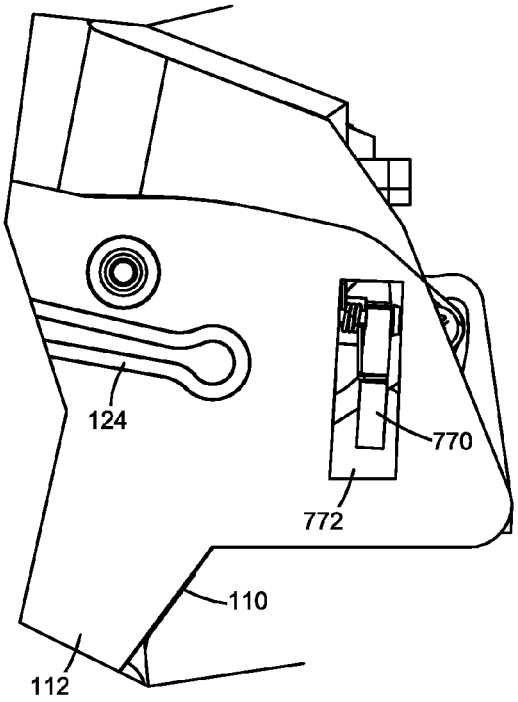
FIG. 21 is a side elevation view of the toner cartridge showing a projection on the side of the toner cartridge in a first position according to a fourth example embodiment.
Figure 22:
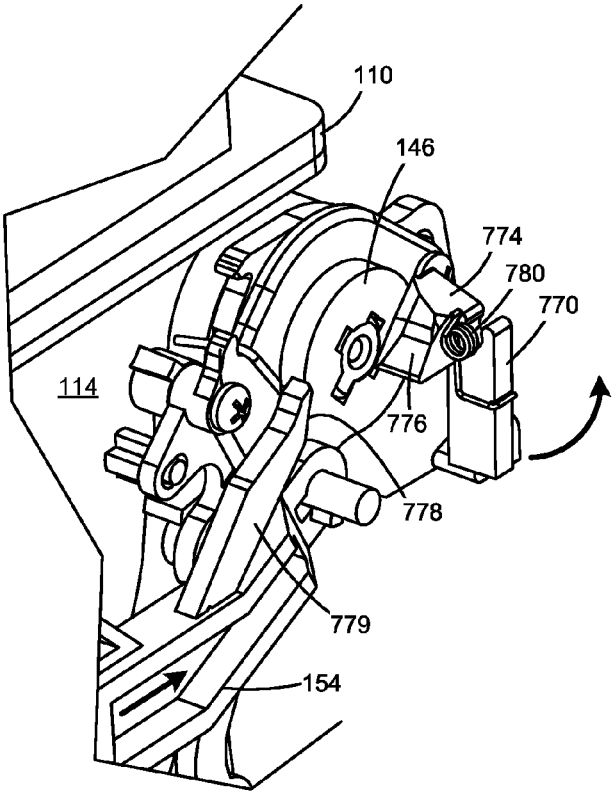
FIG. 22 is a perspective view of the side of the toner cartridge shown in FIG. 21 with the end cap omitted showing the projection in the first position.
Figure 23:
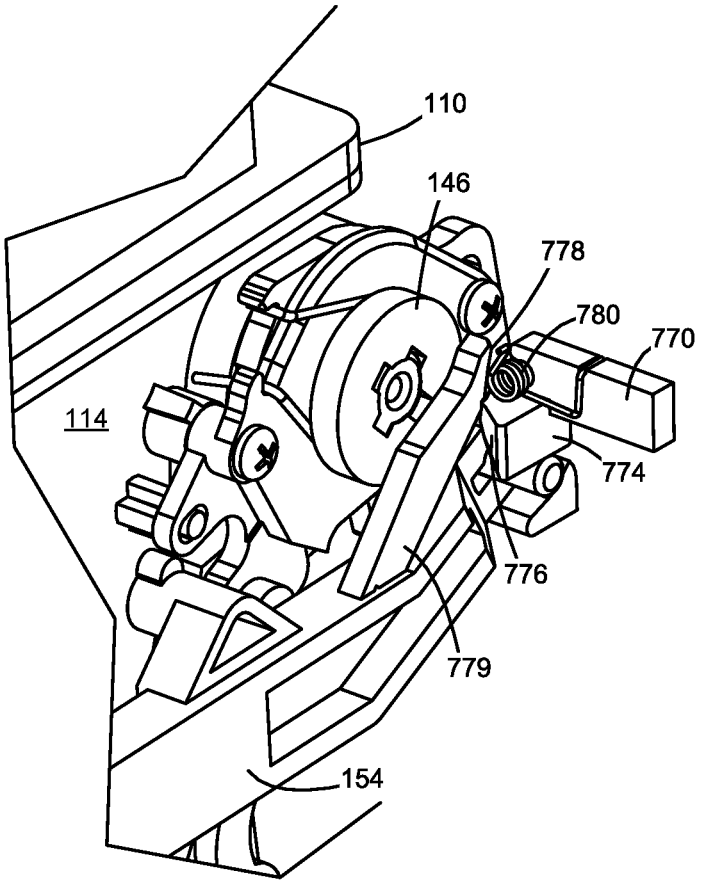
FIG. 23 is a perspective view of the side of the toner cartridge shown in FIGS. 21 and 22 with the end cap omitted showing the projection in a second position.

In another embodiment, the projection on toner cartridge 100 rotates upward and outward from side 108 as the projection moves from its first position to its second position. For example, FIGS. 21-23 show toner cartridge 100 having a projection 770 according to one example embodiment that rotates upward and outward from side 108 as it travels from the first position of projection 770 to the second position of projection 770. As shown in FIG. 21, when projection 770 is in its first position, projection 770 is tucked inside of end cap 112 so that projection 770 does not contact features of image forming device 22 during insertion of toner cartridge 110 into image forming device 22. When projection 770 moves from its first position to its second position, projection 770 swings upward and outward from side 108 through a slot 772 in end cap 112.

FIGS. 22 and 23 show an outer side of side wall 114 with projection 770 in its first and second positions, respectively, and end cap 112 omitted for clarity. In this embodiment, projection 770 is pivotally mounted to end cap 112 and includes a tail 774 that is positioned between end cap 112 and side wall 114. Tail 774 includes a cam surface 776 that is angled to rotate projection 770 upward and outward from side 108 upon receiving a forward force from a front engagement surface 778 of linkage 154. Specifically, cam surface 776 is angled vertically upward and inward sideways as viewed from rear to front relative to housing 102. In the to example embodiment illustrated, front engagement surface 778 is positioned at the front of an extension 779 from linkage 154. When linkage 154 is in its biased position as shown in FIG. 22, projection 770 is positioned in its first position tucked inside of end cap 112 with cam surface 776 in the path of front engagement surface 778 of linkage 154. When engagement surface 155 is depressed, such as when the access door to image forming device 22 is closed, and linkage 154 moves forward, front engagement surface 778 moves forward into contact with cam surface 776. As linkage 154 continues to move forward with front engagement surface 778 contacting cam surface 776, the angle of cam surface 776 relative to the forward motion of front engagement surface 778 causes projection 770 to rotate upward and outward from side 108 from its first position toward its second position as shown in FIG. 23. When the force on engagement surface 155 is removed, such as when the access door to image forming device 22 is opened, linkage 154 moves rearward as a result of the bias applied to linkage 154. The rearward movement of linkage 154 causes extension 779 and front engagement surface 778 to move rearward away from cam surface 776 causing projection 770 to return to its first position. Projection 770 may be biased toward its first position, such as by a spring 780, or projection 770 may rely on gravity to return it to its first position.

Figure 24:
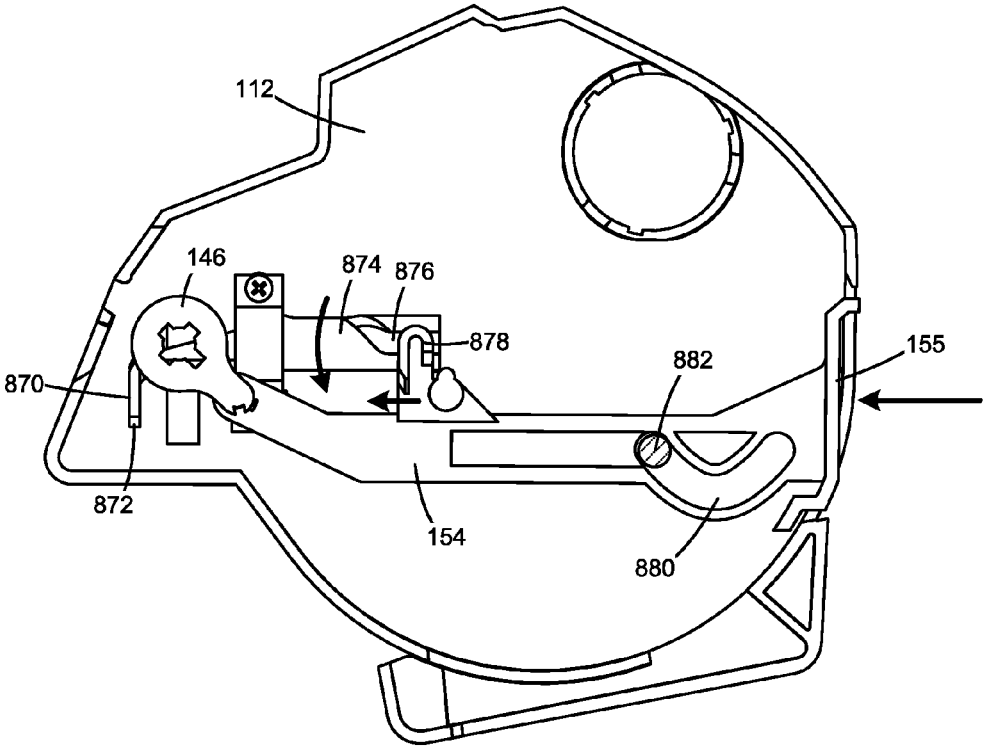
FIG. 24 is a side elevation view of an inner side of an end cap of the toner cartridge showing a projection on the side of the toner cartridge in a first position according to a fifth example embodiment.
Figure 25:
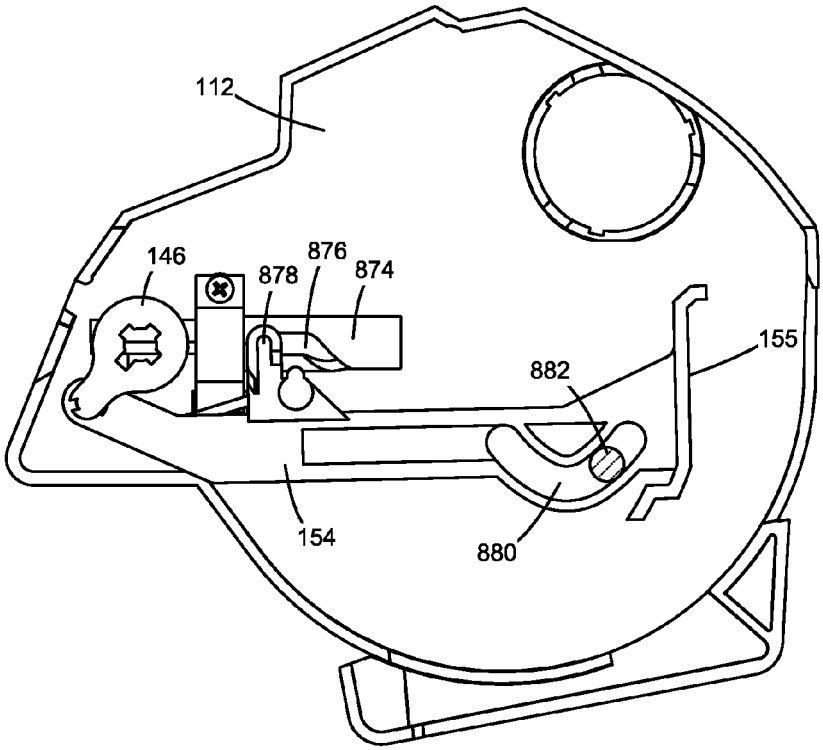
FIG. 25 is a side elevation view of the inner side of the end cap of the toner cartridge shown in FIG. 24 showing the projection in a second position.

FIGS. 24 and 25 show toner cartridge 100 having a projection 870 according to another example embodiment that rotates upward and outward from side 108 as it travels from the first position of projection 870 to the second position of projection 870. Like projection 770 discussed above, when projection 870 is in its first position, projection 870 is tucked inside of end cap 112. Projection 870 swings upward and outward from side 108 through a slot 872 in end cap 112 when projection 870 moves from its first position to its second position. FIGS. 24 and 25 show an inner side of end cap 112 with projection 870 in its first and second positions, respectively, and main body 116 omitted for clarity. In this embodiment, projection 870 is pivotally mounted to end cap 112 and includes a rotating barrel 874 that is positioned on the inner side of end cap 112. Barrel 874 includes a contour groove 876 on an outer surface thereof that runs from the rear of barrel 874 toward the front of barrel 874. Linkage 154 includes a post 878 that extends toward the inner surface of end cap 112 and is positioned in groove 876 of barrel 874. Linkage 154 may also include an elongated guide slot 880 that receives a corresponding guide post 882 on end cap 112 or side wall 114. The engagement between guide slot 880 and guide post 882 guides the movement of linkage 154. Guide slot 880 may have a curved path as illustrated that allows linkage 154 to rise and lower as linkage 154 moves forward or rearward. When linkage 154 is in its biased position as shown in FIG. 24, projection 870 is positioned in its first position tucked inside of end cap 112 with post 878 engaged with a rear portion of groove 876. When engagement surface 155 is depressed, such as when the access door to image forming device 22 is closed, and linkage 154 moves forward, post 878 moves forward in groove 876 causing barrel 874 to rotate according to the contour of groove 876 as a result of the force exerted on barrel 874 by post 878. The rotation of barrel 874, in turn, causes projection 870 to rotate upward and outward from side 108 from its first position toward its second position shown in FIG. 25. When the force on engagement surface 155 is removed, such as when the access door to image forming device 22 is opened, linkage 154 moves rearward as a result of the bias applied to linkage 154. The rearward movement of linkage 154 causes post 878 to move rearward in groove 876 causing barrel 874 and projection 870 to rotate back to the first position of projection 870.

Figure 26:
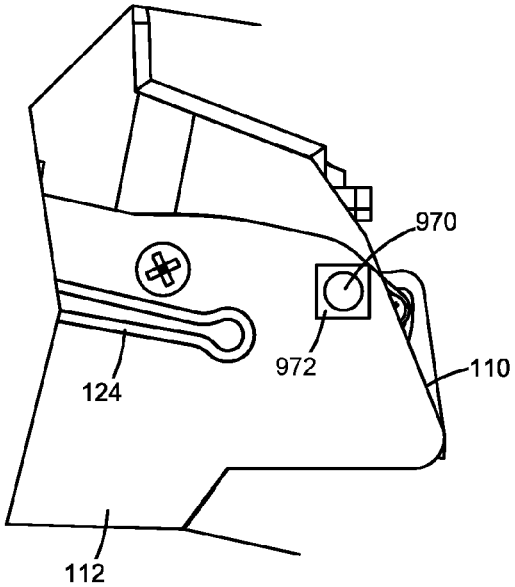
FIG. 26 is a side elevation view of the toner cartridge showing a projection on the side of the toner cartridge in a first position according to a sixth example embodiment.
Figure 27:
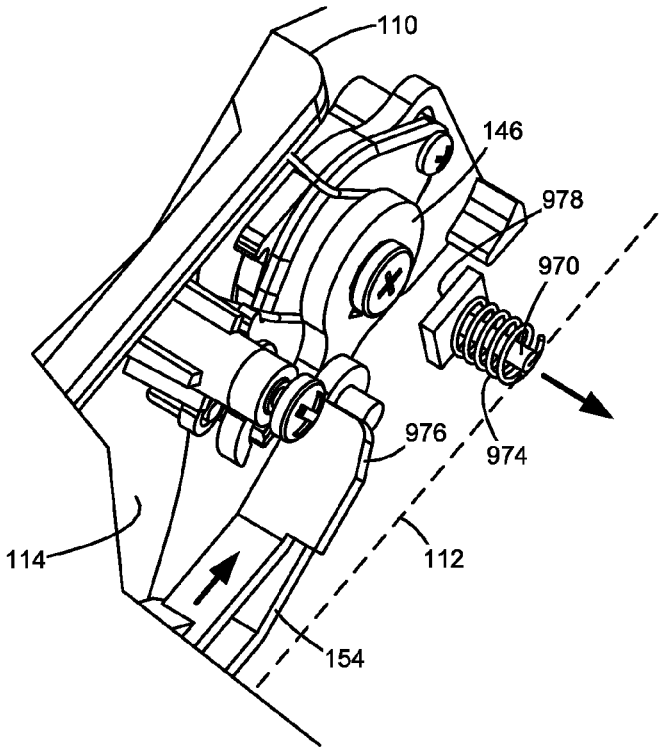
FIG. 27 is a side perspective view of the toner cartridge shown in FIG. 26 with the end cap shown schematically by a dashed line showing the projection in the first position.
Figure 28:
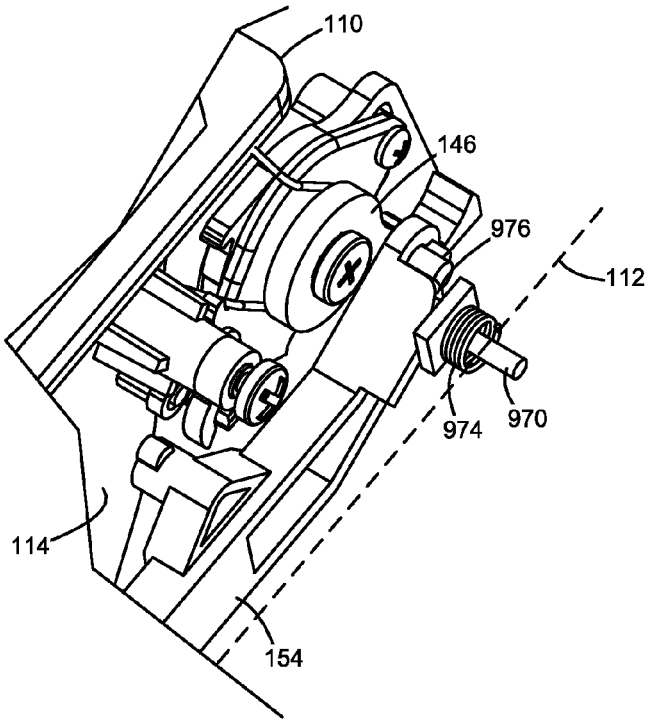
FIG. 28 is a side perspective view of the toner cartridge shown in FIGS. 26 and 27 with the end cap shown schematically by a dashed line showing the projection in a second position.

In another embodiment, gap 304 between emitter 302 and receiver 303 of sensor 300 is accessible from the side and the projection on toner cartridge 100 translates outward from side 108 as the projection moves from its first position to its second position. For example, FIGS. 26-28 show toner cartridge 100 having a projection 970 according to one example embodiment that translates outward from side 108 as it travels from the first position of projection 970 to the second position of projection 970. As shown in FIG. 26, when projection 970 is in its first position, projection 970 is tucked inside of end cap 112. When projection 970 moves from its first position to its second position, projection 970 translates outward from side 108 through a slot 972 in end cap 112.

FIGS. 27 and 28 show an outer side of side wall 114 with projection 970 in its first and second positions, respectively, with the outer surface of end cap 112 shown schematically in dashed line in order to more clearly illustrate the operation of projection 970. In this embodiment, projection 970 is mounted to the inner side of end cap 112 and is biased, such as by a compression spring 974, inward toward side wall 114. Linkage 154 includes a cam surface 976 that is positioned and angled to push projection 970 outward sideways when linkage 154 moves forward. Specifically, cam surface 976 is angled inward sideways as viewed from rear to front relative to housing 102 as illustrated. When linkage 154 is in its biased position as shown in FIG. 27, projection 970 is positioned in its first position tucked inside of end cap 112 as a result of the bias on projection 970. When engagement surface 155 is depressed, such as when the access door to image forming device 22 is closed, and linkage 154 moves forward, cam surface 976 moves forward and contacts an inner surface 978 of projection 970. As linkage 154 continues to move forward with cam surface 976 contacting inner surface 978, the angle of cam surface 976 causes projection 970 to translate outward from side 108 from its first position toward its second position as shown in FIG. 28. Of course inner surface 978 may be angled instead of or correspondingly with cam surface 976 in order to cause projection 970 to move from its first position to it second position. When the force on engagement surface 155 is removed, such as when the access door to image forming device 22 is opened, linkage 154 moves rearward as a result of the bias applied to linkage 154. The rearward movement of linkage 154 causes cam surface 976 to move rearward away from inner surface 978 of projection 970 causing projection 970 to return to its first position.

Figure 29:
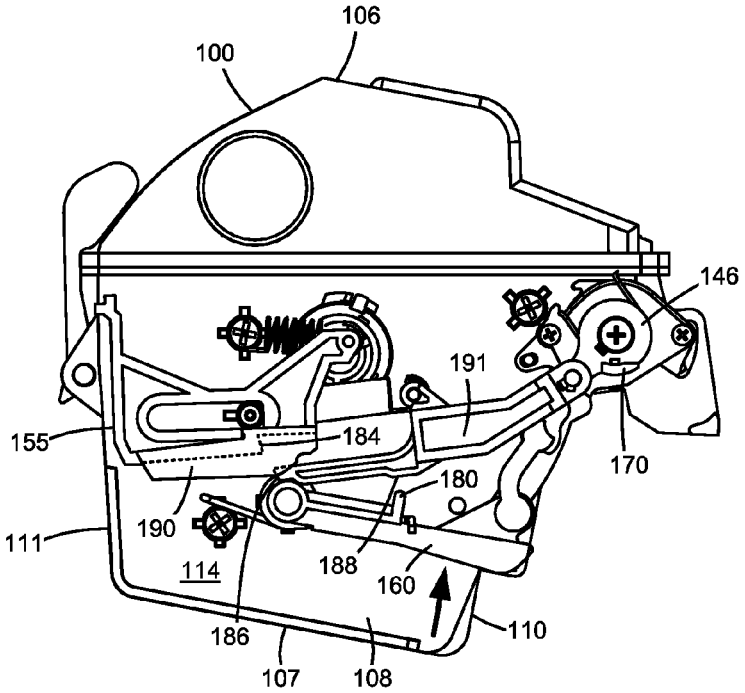
FIG. 29 is a side elevation view of the toner cartridge with the end cap omitted showing a first linkage and a second linkage operatively connected to the projection according to one example embodiment with the second linkage out of alignment with the first linkage.
Figure 30:
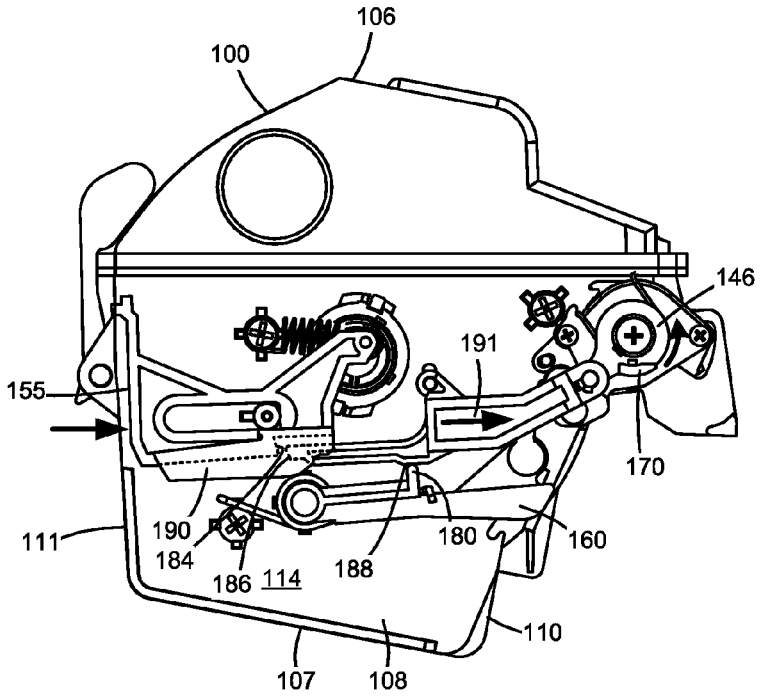
FIG. 30 is a side elevation view of the toner cartridge shown in FIG. 29 with the end cap omitted showing a raisable linkage pushing the second linkage into alignment with the first linkage according to one example embodiment.
Figure 31:
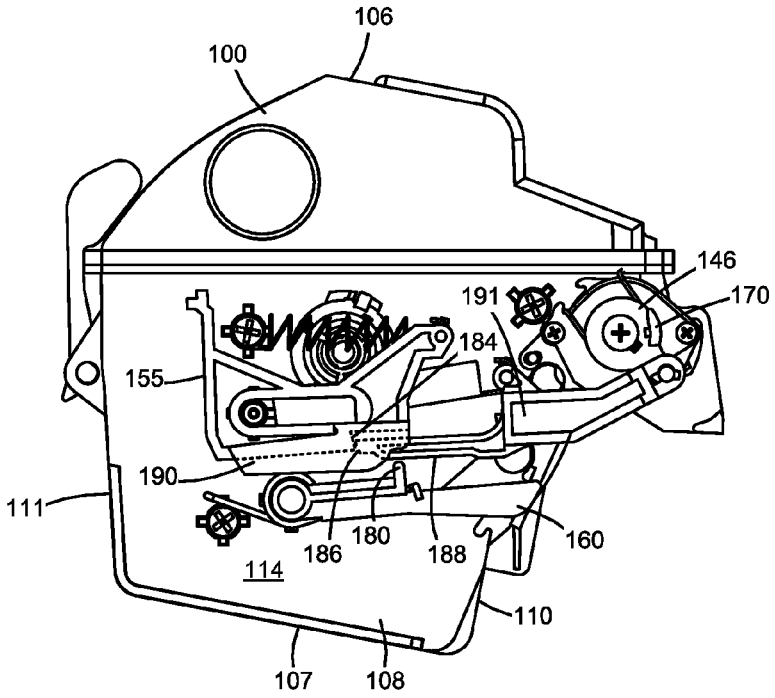
FIG. 31 is a side elevation view of the toner cartridge shown in FIGS. 29 and 30 with the end cap omitted showing the first linkage and the second linkage depressed moving the projection from a first position to a second position according to one example embodiment.

In another embodiment, linkage 154 includes first and second linkage members that cooperate to open shutter 140 and to move projection 170 from its first position to its second position. For example, FIGS. 29-31 show toner cartridge 100 having a first linkage 190 and a second linkage 191 according to one example embodiment. End cap 112 is omitted for clarity in FIGS. 29-31. First linkage 190 includes engagement surface 155 and second linkage 191 is connected at one end to lever 146. In the example embodiment illustrated, projection 170 is configured as described above with respect to FIGS. 9-13; however, the projection may include any suitable construction. In the example embodiment illustrated, linkage 160 serves as an interlock that moves second linkage 191 into alignment with first linkage 190 when linkage 160 is raised by contact between engagement surface 164 and engagement feature 212 in order to prevent shutter 140 from opening unless toner cartridge 100 is installed in image forming device 22 and mated with imaging unit 200. In this embodiment, linkage 160 includes an upward extending post 180 that raises second linkage 191 into alignment with first linkage 190 when linkage 160 is raised.

First linkage 190 and second linkage 191 are biased by respective biasing members toward the rear 111 of housing 102 such that shutter 140 is biased toward the closed position. An inner surface of first linkage 190 includes a catch 184 (shown in dashed lines) that contacts a rear end 186 of second linkage 191 when second linkage 191 is in alignment with first linkage 190 and first linkage 190 moves forward.

FIGS. 29-31 sequentially illustrate the operation of linkages 190 and 191. FIG. 29 shows first and second linkages 190 and 191 and linkage 160 in their biased positions with second linkage 191 out of alignment with first linkage 190. If engagement surface 155 is depressed while second linkage 191 is out of alignment with first linkage 190, catch 184 of first linkage 190 travels above and past rear end 186 of second linkage 191 without contacting rear end 186. As a result, if engagement surface 155 is depressed while second linkage 191 is out of alignment with first linkage 190, second linkage 191 remains in its biased position, shutter 140 does not open and projection 170 remains in its first position. This allows the user to close the access door to image forming device 22 with toner cartridge 100 installed if imaging unit 200 is not present without opening shutter 140. Accordingly, if engagement surface 155 is depressed while second linkage 191 is out of alignment with first linkage 190, projection 170 does not change the state of the sensor so that the sensor continues to indicate to controller 28 that image forming device 22 is not ready to print since imaging unit 200 is not present. FIG. 30 shows linkage 160 in its raised position, such as when toner cartridge 100 is mated with imaging unit 200 and engagement feature 212 contacts engagement surface 164. As linkage 160 moves upward, post 180 contacts a bottom surface 188 of second linkage 191 and pushes second linkage 191 upward into alignment with first linkage 190 with rear end 186 of second linkage 191 in the path of catch 184. FIG. 31 shows first linkage 190 moved forward when engagement surface 155 is depressed, such as when the access door to image forming device 22 is closed. When first linkage 190 moves forward and second linkage 191 is aligned with first linkage 190, catch 184 contacts rear end 186 of second linkage 191 overcoming the bias on second linkage 191 and pushing second linkage 191 forward. The forward movement of second linkage 191 causes lever 146 to rotate to open shutter 140 and move projection 170 from its first position to its second position as discussed above. When toner cartridge 100 is removed from image forming device 22, this sequence is reversed. When the access door to image forming device 22 is opened, first linkage 190 and second linkage 191 retract to their biased positions closing shutter 140 and moving projection 170 to its second position. As the user removes toner cartridge 100 from image device 22, engagement feature 212 on imaging unit 200 disengages from engagement surface 164 causing linkage 160 to lower to its biased position. As linkage 160 lowers, second linkage 191 lowers until rear end 186 is no longer in the path of catch 184 on first linkage 190.

In another embodiment, the projection (such as projection 170) on toner cartridge 100 is operatively connected to linkage 160 such that the projection moves from its first position to its second position when linkage 160 contacts engagement feature 212 on frame 206 of imaging unit 200 to indicate when toner cartridge 100 is mated with imaging unit 200. However, in this embodiment, the position of the projection does not indicate whether the access door to image forming device 22 is open or closed or whether shutter 140 is open or closed.

As discussed above, it will be appreciated that the configurations of the projection on toner cartridge 100 and the corresponding sensor are not limited to the example embodiments illustrated. The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An electrophotographic image forming device, comprising:

a toner cartridge including:

a housing having a top, a bottom, a front, and a rear positioned between a first side and a second side of the housing, the housing has a reservoir for holding toner;

an outlet port in fluid communication with the reservoir and facing downward on the front of the housing near the first side of the housing for exiting toner from the toner cartridge;

a linkage on the first side of the housing, the linkage has an engagement surface that is accessible at the rear of the housing; and a projection on the first side of the housing, the projection is movable between a first position and a second position, the projection extends outward sideways from the first side when the projection is in the second position, the projection is operatively connected to the linkage such that the projection moves upward from the first position to the second position when the engagement surface receives a forward force that is toward the front of the housing, the projection is unobstructed to contact and push upward on an arm in the image forming device when the projection moves upward from the first position to the second position in order to change a state of a sensor in the image forming device when the toner cartridge is installed in the image forming device.

2. The electrophotographic image forming device of claim 1, wherein the projection is biased toward the first position.

3. The electrophotographic image forming device of claim 1, wherein the linkage is biased rearward toward the rear of the housing.

4. The electrophotographic image forming device of claim 1, wherein the toner cartridge includes an alignment guide that extends outward sideways on the first side of the housing, wherein in the second position a top portion of the projection is positioned higher than at least a portion of a top surface of the alignment guide.

5. The electrophotographic image forming device of claim 1, wherein the toner cartridge includes an alignment guide that extends outward sideways on the first side of the housing, wherein in the first position the projection extends outward sideways from the first side and is in line with the alignment guide from the rear to the front of the housing.

6. The electrophotographic image forming device of claim 5, wherein the alignment guide runs from the rear to the front of the housing on the first side of the housing.

7. The electrophotographic image forming device of claim 6, wherein the alignment guide includes a shield positioned in front of the projection when the projection is in the first position.

8. The electrophotographic image forming device of claim 1, wherein the projection moves outward sideways from the first side as the projection moves from the first position to the second position.

9. The electrophotographic image forming device of claim 1, wherein the toner cartridge includes a shutter movable between a closed position blocking the outlet port and an open position unblocking the outlet port, wherein the shutter is operatively connected to the linkage such that the shutter moves from the closed position to the open position when the engagement surface receives the forward force that is toward the front of the housing.

10. The electrophotographic image forming device of claim 1, wherein the toner cartridge includes:

a channel running along the front of the housing between the first side and the second side in fluid communication with the outlet port, at least a portion of the channel is open to the reservoir; and an auger positioned in the channel and extending along the front of the housing between the first side and the second side, the auger is operative to move toner in the channel toward the outlet port, wherein in the second position a top portion of the projection is positioned higher than a bottom surface of the channel.

11. The electrophotographic image forming device of claim 1, wherein the toner cartridge includes:

a channel running along the front of the housing between the first side and the second side in fluid communication with the outlet port, at least a portion of the channel is open to the reservoir; and an auger positioned in the channel and extending along the front of the housing between the first side and the second side, the auger is operative to move toner in the channel toward the outlet port, wherein in the second position a top portion of the projection is positioned in line with the channel from second side to the first side of the housing.

12. The electrophotographic image forming device of claim 1, wherein the toner cartridge includes:

a channel running along the front of the housing between the first side and the second side in fluid communication with the outlet port, at least a portion of the channel is open to the reservoir;

an auger positioned in the channel and extending along the front of the housing between the first side and the second side, the auger is operative to move toner in the channel toward the outlet port; and a toner delivery assembly positioned in the reservoir to deliver toner to the channel, the toner delivery assembly includes a drive shaft rotatably mounted in the reservoir, the drive shaft includes a rotational axis, wherein in the second position a top portion of the projection is positioned higher than the rotational axis of the drive shaft.

13. An electrophotographic image forming device, comprising:

a toner cartridge including:

a housing having a top, a bottom, a front, and a rear positioned between a first side and a second side of the housing, the housing has a reservoir for holding toner;

an outlet port in fluid communication with the reservoir and facing downward on the front of the housing near the first side of the housing for exiting toner from the toner cartridge;

a linkage on the first side of the housing, the linkage has an engagement surface that is accessible at the rear of the housing to receive an actuation force at the rear of the housing, the linkage is movable forward toward the front of the housing upon the engagement surface receiving the actuation force at the rear of the housing; and a flag on the first side of the housing, the flag is movable between a first position and a second position, the flag extends outward sideways from the first side when the flag is in the second position, the flag is operatively connected to the linkage such that forward movement of the linkage causes the flag to move upward from the first position to the second position permitting the flag to change a state of a sensor in the image forming device when the toner cartridge is installed in the image forming device.

14. The electrophotographic image forming device of claim 13, wherein the flag is biased toward the first position.

15. The electrophotographic image forming device of claim 13, wherein the linkage is biased rearward toward the rear of the housing.

16. The electrophotographic image forming device of claim 13, wherein the toner cartridge includes an alignment guide that extends outward sideways on the first side of the housing, wherein in the second position a top portion of the flag is positioned higher than at least a portion of a top surface of the alignment guide.

17. The electrophotographic image forming device of claim 13, wherein the toner cartridge includes an alignment guide that extends outward sideways on the first side of the housing, wherein in the first position the flag extends outward sideways from the first side and is in line with the alignment guide from the rear to the front of the housing.

18. The electrophotographic image forming device of claim 17, wherein the alignment guide runs from the rear to the front of the housing on the first side of the housing.

19. The electrophotographic image forming device of claim 18, wherein the alignment guide includes a shield positioned in front of the flag when the flag is in the first position.

20. The electrophotographic image forming device of claim 13, wherein the flag moves outward sideways from the first side as the flag moves from the first position to the second position.

21. The electrophotographic image forming device of claim 13, wherein the toner cartridge includes a shutter movable between a closed position blocking the outlet port and an open position unblocking the outlet port, wherein the shutter is operatively connected to the linkage such that forward movement of the linkage causes the shutter to move from the closed position to the open position.

22. The electrophotographic image forming device of claim 13, wherein the toner cartridge includes:

a channel running along the front of the housing between the first side and the second side in fluid communication with the outlet port, at least a portion of the channel is open to the reservoir; and an auger positioned in the channel and extending along the front of the housing between the first side and the second side, the auger is operative to move toner in the channel toward the outlet port, wherein in the second position a top portion of the flag is positioned higher than a bottom surface of the channel.

23. The electrophotographic image forming device of claim 13, wherein the toner cartridge includes:

a channel running along the front of the housing between the first side and the second side in fluid communication with the outlet port, at least a portion of the channel is open to the reservoir; and an auger positioned in the channel and extending along the front of the housing between the first side and the second side, the auger is operative to move toner in the channel toward the outlet port, wherein in the second position a top portion of the flag is positioned in line with the channel from the second side to the first side of the housing.

24. The electrophotographic image forming device of claim 13, wherein the toner cartridge includes:

a channel running along the front of the housing between the first side and the second side in fluid communication with the outlet port, at least a portion of the channel is open to the reservoir;

an auger positioned in the channel and extending along the front of the housing between the first side and the second side, the auger is operative to move toner in the channel toward the outlet port; and a toner delivery assembly positioned in the reservoir to deliver toner to the channel, the toner delivery assembly includes a drive shaft rotatably mounted in the reservoir, the drive shaft includes a rotational axis, wherein in the second position a top portion of the flag is positioned higher than the rotational axis of the drive shaft.

* * * * *